United States Patent [19]

David

[11] Patent Number: 4,760,701

[45] Date of Patent: Aug. 2, 1988

[54] EXTERNAL COMBUSTION ROTARY ENGINE

[76] Inventor: Constant V. David, 4952 Field St., San Diego, Calif. 92110

[21] Appl. No.: 893,701

[22] Filed: Aug. 6, 1986

Related U.S. Application Data

[63] Continuation-in-part of Ser. No. 866,944, May 27, 1986, Pat. No. 4,702,205, and a continuation-in-part of Ser. No. 866,945, May 27, 1986, Pat. No. 4,672,813, and a continuation-in-part of Ser. No. 866,946, May 27, 1986, Pat. No. 4,665,703, which is a continuation-in-part of Ser. No. 789,451, Oct. 21, 1985, Pat. No. 4,653,274, which is a continuation-in-part of Ser. No. 586,812, Mar. 6, 1984, Pat. No. 4,561,252.

[51] Int. Cl.[4] ..... F02B 71/04

[52] U.S. Cl. ..... 60/595; 123/228; 418/61.2

[58] Field of Search ..... 60/39.6, 595; 123/204, 123/228; 418/61 A

[56] References Cited

U.S. PATENT DOCUMENTS

| | | | |
|---|---|---|---|
| 4,015,424 | 4/1977 | Shinohara | 123/228 X |
| 4,399,654 | 8/1983 | David | 123/228 X |
| 4,672,813 | 6/1987 | David | 60/595 |

FOREIGN PATENT DOCUMENTS

| | | | |
|---|---|---|---|
| WO86/06437 | 11/1986 | Pct Int'l Appl. | 123/204 |
| 1392190 | 4/1975 | United Kingdom | 123/204 |

*Primary Examiner*—Michael Koczo

[57] ABSTRACT

An external combustion rotary engine comprising a motor member, a free-piston combustion member and a storage tank serving also as a heat exchanger and located between the motor and the combustor. The motor rotors rotate inside an enveloping structure eccentrically with respect to a power shaft to form alternatively compression and expansion chambers. Compressed air produced thereby is ducted first to the storage tank and then to the combustor for burning fuel to produce combusted gases which are in turn ducted to the storage tank where heat is exchanged between the hot gases and the cooler compressed air. The combusted gas is then expanded in the expansion chambers. A fraction of the compressed air is further compressed to a higher pressure level so that it may be used in air pad cushions to isolate the various engine rotating parts from the fixed structures surrounding them. The use of such air cushions prevents contacts between moving parts and eliminates friction, heat production therefrom and wear. The need for lubrication is thus also eliminated. The "externally" performed fuel combustion is much slower than in comparable internal combustion rotary engines. This results in higher combustion efficiencies, lower combustion temperatures and lower rates of production of pollutants such as $NO_x$.

28 Claims, 3 Drawing Sheets

FIG. 3
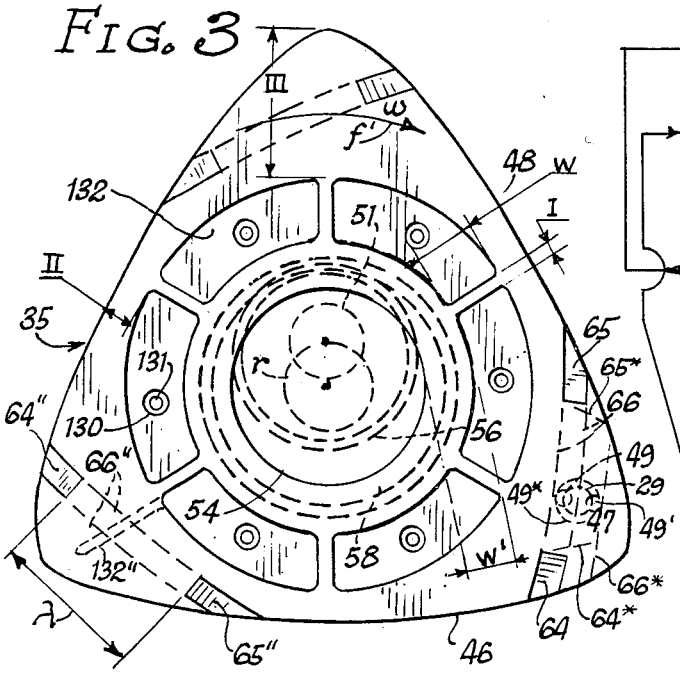
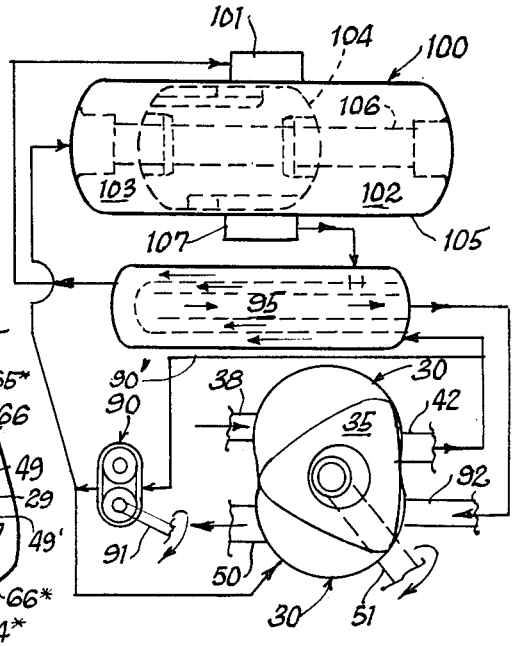
FIG. 5
FIG. 9
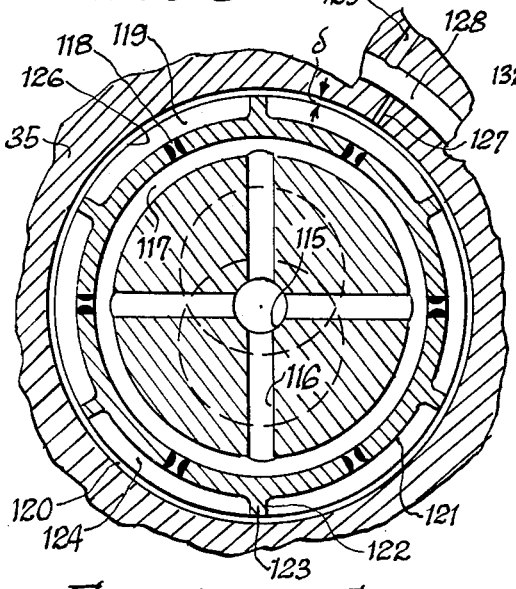
FIG. 8
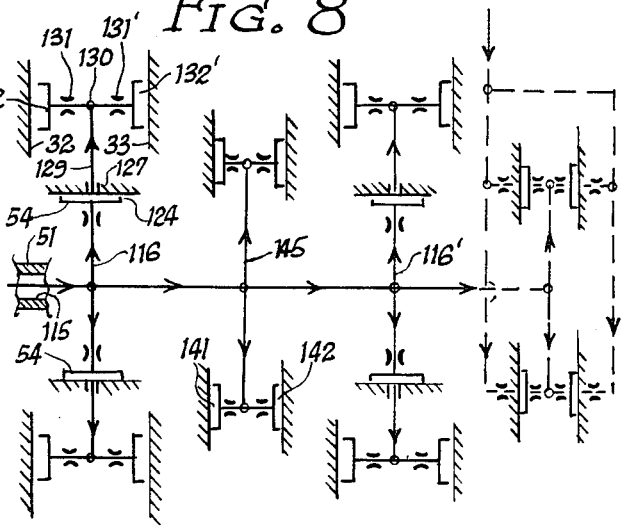
FIG. 11
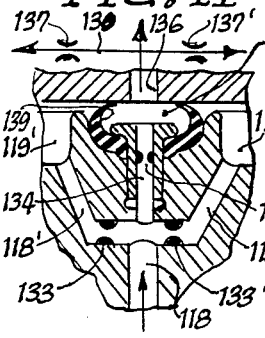
FIG. 10
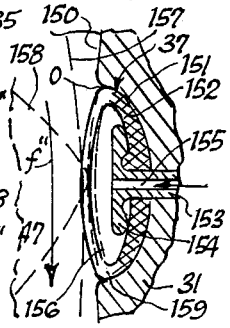
FIG. 12
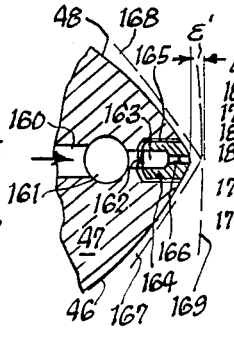
FIG. 13
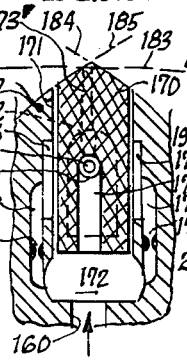
FIG. 14
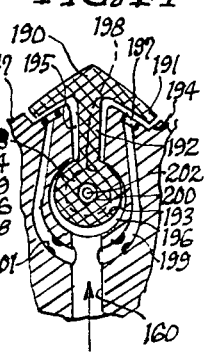

EXTERNAL COMBUSTION ROTARY ENGINE

CROSS-REFERENCE TO RELATED APPLICATIONS

This application is a continuation-in-part of Ser. No. 866,944, May 27, 1986, U.S. Pat. No. 4,702,205; Ser. No. 866,945, May 27, 1986, U.S. Pat. No. 4,672,813, and Ser. No. 866,946, May 27, 1986, U.S. Pat. No. 4,665,703; which are continuations-in-part of Ser. No. 789,451, Oct. 21, 1985, U.S. Pat. No. 4,653,274; which is a continuation-in-part of Ser. No. 586,812, Mar. 6, 1984, U.S. Pat. No. 4,561,252.

BACKGROUND OF THE INVENTION

The present invention relates to an external combustion engine which combines the advantages of a free-piston combustion in which combustion proceeds externally to the motor at very slow rates and of a WANKEL rotary engine in which eccentrically-mounted rotors act as pistons without the assistance of connecting rods, thereby eliminating the alternating motion of massive engine components and ensuing brusquely varying alternatively oriented loads. This enables air cushions to be used between the sliding surfaces of cooperating engine parts.

The motor members of the external combustion engines described in my prior U.S. Patents are also of the rotary type. However, they all use vanes moveable with respect to the rotor. The vanes function so as to form variable-volume confined spaces in which either air compression or gas expansion takes place. The vanes are not positively urged to maintain their geometrical relationships with respect to the two other positively positioned structures which cooperate with the vanes to form such spaces. As a result, the amount of compression and/or expansion that may be obtainable between two contiguous vanes is limited. The number of vanes positionable between the two structures is also necessarily limited for practical reasons. Thus the compression or expansion ratio obtainable per rotor assembly is limited to values that are only a fraction of the compression ratio which an engine must have in order to reach the thermodynamic cycle efficiencies of present piston engines. Such inherent limitations of vane motors force the engine designer to use at least two or preferably three "stages" arranged in series. Ducting of the air and of the combusted gas is thus required between stages.

Because vanes cannot be forcefully radially positioned as the relative rotating motion of the two positively positioned structures takes place, forces must be exerted on the vanes to urge them to seal these intervane spaces. Three types of forces are commonly used, either separately or in conjunction: i.e. centrifugal forces, pressure forces and/or spring forces. Although a vane motor may be designed to operate ideally at a certain rotational speed, using one or more of these forces, it is either difficult or ineffective to make a combination thereof operate equally well at all speeds and/or engine regimes. However, rotary machinery of the type studied and developed by Pr. Felix Wankel (e.g. the Wankel rotary engine) using a single rotor revolving inside an especially spaced containment structure can theoretically provide a mechanically-assured positive positioning of the rotor and insure sealing, without the use of vanes. Thus it appears that combining a Wankel-type of rotary motor with a free-piston combustor may offer promises of simplicity as compared to those obtainable with a rotary vane motor association.

In view of this background, it is an object of the present invention to provide a new and improved combustion engine which combines the most advantageous constructions features of the two types of engines mentioned above but embodied into a simpler engine construction which will operate equally well with various types of fuels reliably and during a longer lifetime.

It is another object of the present invention to provide an improved external combustion engine of simpler construction with fewer simpler mechanical moving parts.

It is another object of the present invention to provide a new and improved engine in which solid friction between moving parts is eliminated, thereby eliminating the need for lubrication and cooling, while minimizing surface wear.

It is another object of the present invention to provide an improved engine in which full expansion of the combusted gases can be achieved, thereby improving the engine thermodynamic cycle efficiency and lowering fuel consumption.

Finally it is still another object of the present invention to provide a new and improved external combustion engine in which heat exchange takes place between the compressed air and the combusted gases, whereby a further increase of thermodynamic cycle efficiency and a further decrease of fuel consumption are obtained, while lower rates of pollutant emission result.

SUMMARY OF THE INVENTION

The above objects are retained by an external combustion engine utilizing a rotary motor member including air compression means connected to separate external combustion means. The combusted gases produced therein pass from the combustion means into combusted gas expansion means which provides power for driving the compression means and generates useable shaft power.

Accordingly, the present invention provides: (1) a rotary motor in which a single eccentrically-mounted rotor performs two main functions: air compression and combusted gas expansion; (2) a free-piston combustion member of burning fuel in the compressed air; and (3) a combination of storage tank and heat exchanger in which compressed air and combusted gas are provisionally stored while heat exchange takes place therebetween. The combustion process is temporally divorced from the functions of air compression and combusted gas expansion, so that fuel combustion may proceed at a rate independent of the operating regime of the motor. Fuel combustion thus is given more to become more complete and to take place at lower temperatures. The sudden side leadings created by the explosion of the fuel/air mixture and applied on the rotor sides in the Wankel rotary engine are eliminated. This results in a smoother running of the engine and facilitates the generalized use of air-cushion supporting journals.

Mechanical contacts between adjacent moving parts are prevented. The elimination of solid friction between sliding surfaces means that both localized generations of heat and wear are also prevented, thus disposing of the need for cooling and/or lubrication. The structural portions of the moving parts having sliding surfaces are configured and constructed in a manner such that a minimum amount of high pressure compressed air is needed for the operation of the air-cushion journals.

DESCRIPTION OF THE DRAWINGS

FIG. 3 is a plan view of the rotor of the rotary motor as shown in FIGS. 1 and 2.

FIG. 5 is a schematic arrangement of the external combustion engine of the present invention showing how the separate members of the engine are connected.

FIG. 8 is a diagrammatic representation of the high pressure air system which supplies the various air cushions.

FIG. 9 is a schematic drawing showing how the restricting orifices and the air connections therewith may be arranged for supplying high pressure air to the air cushions of a journal.

FIG. 10 is a cross-sectional view of a typical seal located between the air and gas sides of a rotary motor.

FIG. 11 is a partial cross-sectional view of the ducting and sealing arrangements used for channelling high pressure air through the rotor journal.

FIG. 12 is a partial cross-sectional view of a rotor apex seal using a high pressure air jet.

FIG. 13 is a partial cross-sectional view of a rotor apex seal using a sliding seal arrangement.

FIG. 14 is a partial cross-sectional view of a rotor apex seal using a tilting rest pad arrangement.

DETAILED DESCRIPTION OF THE INVENTION

Figure 1:
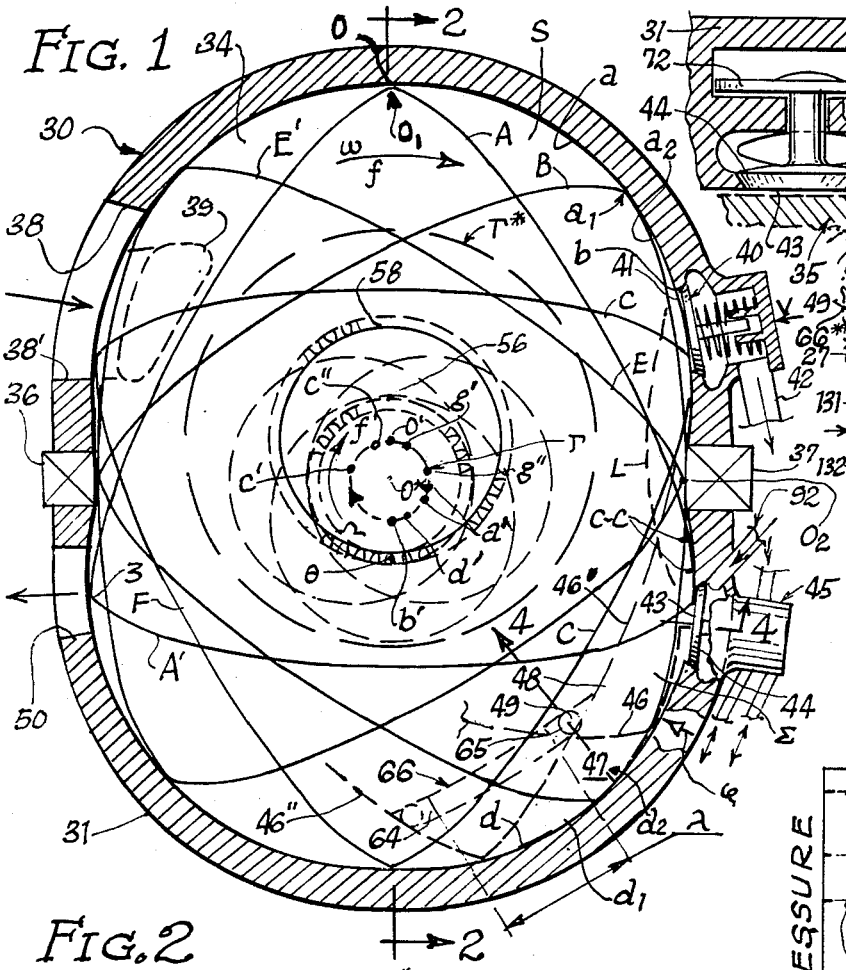
FIG. 1 is a diagrammatic midsectional plan view of a modified Wankel rotary engine for operation as a motor member.
Figure 2:
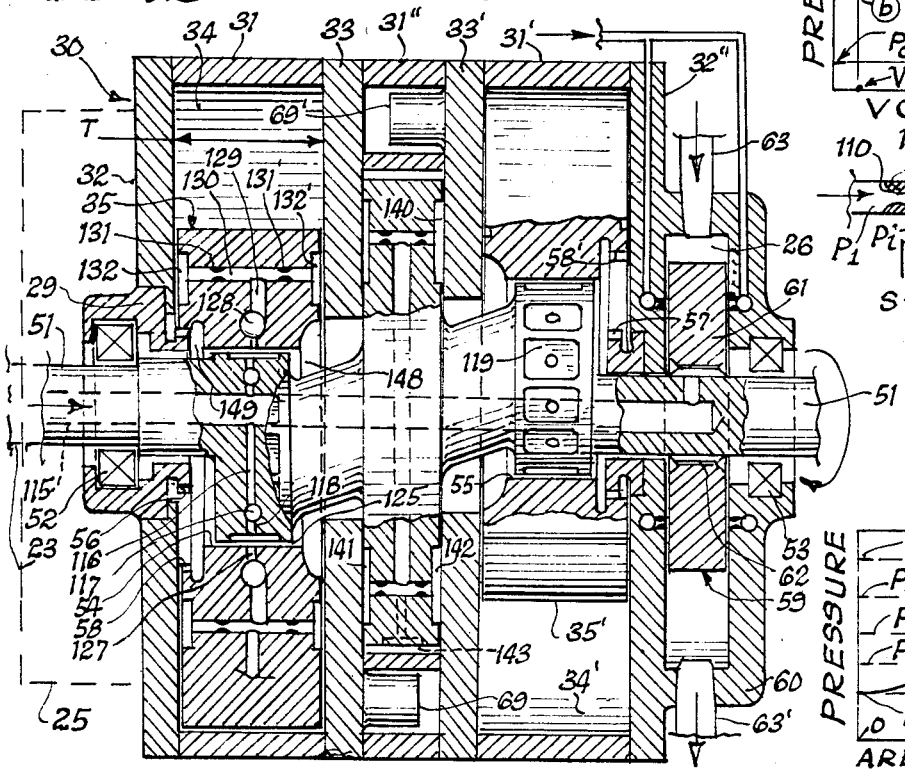
FIG. 2 is a midsectional elevation view of the rotary motor of FIG. 1 taken along section line 2—2 of FIG. 1.

Referring to FIGS. 1 and 2 of the drawings, the motor member 30 of the subject external combustion engine comprises an outer structural casing or shell 31 sandwiched between two flange walls 32 and 33. The assembly of shell and walls defines an internal space 34 in which rotor 35 is positioned so as to revolve in arrow f direction as indicated by various positions such as A, B, C and E for instance, and assumed sequentially by rotor 35. Rotor 35 contour is defined by three identical curved surfaces that intersect along three parallel lines. The intersections of these lines with the plane of FIG. 1 determine three points that form the apices of an equilateral triangle. The embodiment of the invention presented in FIGS. 1 and 2 includes two such rotors with their associated shell/wall assemblies. The call-out numbers shown on the left side of FIG. 2 are repeated on the right side as applicable but are "primed" (') for ease of recognition. Rotor 35 is shown with an apex down and rotor 35' is represented with an apex up.

Seals 36 and 37 prevent communications between the upper and the lower chambers formed by the rotor in the shell. Conventionally, the upper chamber is used for air compression and the lower chamber is used for combusted gas expansion, although these roles can be reversed with proper reversal of the valving means. Sealing is accomplished between the rotor apices and the shell inner surface by a seal not shown here but described later. Sealing between the rotor curved surfaces and the shell inner surface is required only at the locations of seals 36 and 37. The sealing of the gaps between the rotor faces and the flange walls is performed by means of air cushions which are described later.

Ambient air is introduced through openings such as 38 in the wall of shell 31 and/or 39 in flange 33. As rotor 35 moves from a position such as E' to a position past A, air trapped in chamber 34 is compressed and, when its pressure reaches an appropriate level, check valve 40 opens and compressed air is allowed to exit through opening 41 for piping through duct 42. Conversely, pressurized combusted gas is introduced through opening 43 when an apex of rotor 35 has passed by. An inlet valve 44 automatically opens when the front edge (or leading curved surface) 46 of lobe 47 corresponding to that apex passes over sensor 49. The construction and positioning of these components are such that valve assembly 45 causes valve 44 to start opening when the apex reaches an angular position indicated by arrow $\phi$. As lobe 47 is caused to proceed with its sweeping displacement, rear edge (or trailing curved surface) 48 approaches sensor 49. At that time, progressively, sensor 49 is allowed to protrude back into a new expansion chamber being formed. Valve 44 closes opening 43 and combusted gas admission is stopped. The amount of combusted gas already introduced in the chamber at that time is represented by the space delineated by contour 48 and the portion of shell 31 inner surface opposite thereto. As lobe 47 pursues its course, this space augments in size and the combusted gas trapped therein is allowed to expand until surface 48 nears position A', at which time the apex starts uncovering opening 50 that constitutes the exhaust valving port. The expanded gas contained in the expansion chamber is gradually pushed out while pressurized combusted gas is gradually introduced on the other side of the dividing rotor lobe, as previously described.

Rotor 35 is caused to follow two basic motions in the plane of FIG. 1: (1) a general rotation about central point 0* (direction of arrow f') as one rigid body, and (2) a specific rotation around its own center 0' (direction of arrow f). Point 0' is rotor 35 (A) center and provisionally assumed to be the center of instantaneous rotation (CIR) of the rotor for convenience now and is caused to follow a circular path represented by circle $\Gamma$ (locus of all the CIR's). These two imposed simultaneous rotations thus impose a determined path to any and all points on rotor 35 surfaces, and more particularly to the apex lines which then become generatices of the cylindrical inner surface of shell 31 wall. Such coordinated and programmed rotor rotations and apex motions are imposed by geometric constraints which restrain and guide rotor 35 in its resulting actual movement.

These constraints are introduced by means of: (1) shaft 51 centered by bearings 52 and 53 with respect to the fixed motor structure, (2) off-centered shaft portions of journals 54 and 55 which rotate with shaft 51, (3) centered gear 56 and 57 which are affixed to the fixed structure, and (4) cooperating gears 58 and 58' which mesh internally with gears 56 and 57 respectively, and are mounted on rotors 35 and 35' respectively. Thus, any and all pressure-created forces applied on the rotor are automatically off-centered with respect to 0* and are caused to generate a torque exerted on shaft 51. The latter thus rotates. As it does so, because of gear 58 engaging fixed gear 56 the rotor is urged to move along the only degree of freedom which is offered, i.e. rotating around a point such as 0'. The relative size of the engaging gears determines the ratio of the angular velocities characterizing the two simultaneous rotations. The gear ratio adopted herein is $\frac{2}{3}$ and the ratio of $\omega/\Omega$ is $\frac{1}{3}$, i.e. shaft 51 rotating three times faster than rotor 35 rotates around its CIR.

Because rotor 35 has three sides (curved surfaces), one revolution of shaft 51 results in one air compression and one combusted gas expansion. Because a crankshaft effect is used (shaft 51) and because each rotor side reacts thereon as a piston would by means of its connecting rod, this type of mechanical interaction is referred to as that of a "rotary piston", albeit no piston as such in a conventional sense is utilized here.

Because of the symmetry imposed to the various movements of the shaft and the rotor about the two principal axes passing through point 0*, the spaces defined by and contained between the rotor curved surfaces and the shell inner surface vary identically, be it for air compression or combusted gas expansion. Except for the minimal influence of the valving means, inlet and outlet alike, the ratios of maximum to minimum values of these space volumes thus are the same for compression and expansion. As is discussed later, it is advantageous to enable the combusted gas to expand volumetrically to a degree larger than that ratio which corresponds to the associated compression of the air used for generating that combusted gas. Thus an additional expansion stage is provided by stage 59 located on the right portion of FIG. 2 between flange 32' and end flange 60. For various reasons elaborated on later, it is also necessary to provide air at a pressure higher than that of the compressed air supplied by the motor compressor. Because means can also easily be incorporated in the motor construction for compensating for differences in compression and expansion ratios, additional stage 59 could then be utilized for generating high pressure air. Otherwise, a second additional stage can be incorporated on the left side of FIG. 2, as shown in phantom lines such as 25 with a shaft extension 23. Various possible combinations are described at the end of this section. In any case, stage 59 is shown including a rotor 61 mounted on shaft 51 by means of splines 62, for a gas expansion use. Should a stage 25 be used for air compression, an off-centered journal such as 54 and a rotor similar to, but of much smaller size than, rotor 35 cooperate to form two chambers, both being used for compression. Inlet duct 63 and outlet duct 63' service stage 59.

FIG. 3 depicts rotor 35 removed from the motor. Shaft 51 is shown in a phanton line circle for reference. Its center line represented by point 0* describes circle Γ, assuming that rotor 35 remains fixed and shaft 51 is free to rotate. Journal 56 contour is centered around 0' and 0* is off-centered therewith. Two typical side surfaces 46 and 48 are identified with respect to lobe 47. The outline of a typical sensor 49 is also shown for reference. In oreder to facilitate the engagement of sensor 49 tip that normally protrudes beyond the plane in which the rotor face shown slides, and its progressive disengagement, two ramps 64 and 65 are cut in the rotor lobes. Sensor 49 tip follows a path indicated by phantom lines 66. During travel λ (interspace located between contiguous ends of the two ramps), sensor 49 tip slides on the rotor face surface. The value of 80 determines the length of time during which valve 44 remains open.

Figure 4:
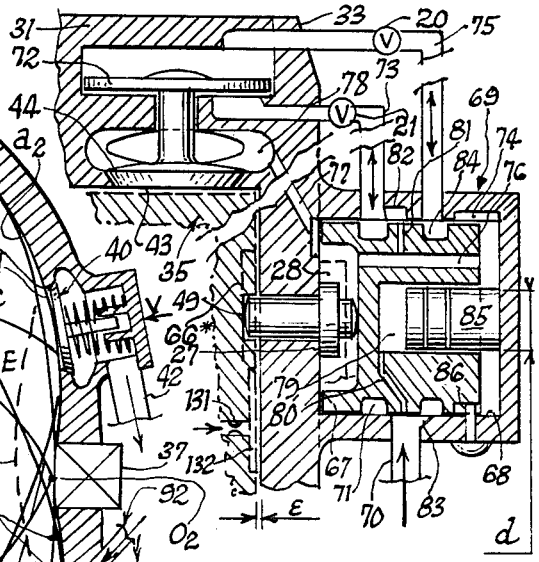
FIG. 4 is a partial sectional view of the combusted gas inlet valve and of its actuating mechanism taken along section line 4—4 of FIG. 1.

Referring to the drawing of FIG. 4, sensor 49 pushes shuttle piston 67 inside cylinder 68 of control valve 69 which monitors combusted gas inlet valve 44 whenever the portion λ of a rotor lobe passes by arrow φ. High pressure air is admitted through duct 70 which introduces this air in circular groove 71 when the sensor is pushed in. High pressure air is then introduced under piston 72 by means of duct 73. Conversely, the space above piston 72 is vented to straight groove 74 by means of duct 75, then to vent duct 77 through a plurality of holes 76 in piston 67. Duct 77 vents into manifold space 78 where a lower combusted gas pressure always exists. The pressure differential across piston 72 exerts a lift force which causes valve 44 to open. When sensor 49 is free to return back to its normal original position, the high pressure permanently existing in space 79 by means of duct 80 pushes piston 67 back toward the left, to its rest position.

At such time, duct 73 is allowed to communicate with duct 81 by means of straight groove 82 and with the spaces on both ends of piston 67. However, circular groove 84 then is caused to communicate with duct 70 by means of local slot 83. Thus, full high pressure becomes applied on top of piston 72, while the pressure underneath it falls. This action causes valve 44 to close. Combusted gas admission is stopped. Furthermore, the combination of combusted gas pressure pushing on valve 44 and of pressure differences across piston 72 insures that valve 44 remains steadily closed, except when sensor 49 is pushed in. The diameter d of stem 85 and piston 67 dimensions and travels are such that piston 67 is permitted to assume only two positions: extreme right and extreme left. Piston 67 is prevented from rotation by means of dowel pin 86 engaging a cooperating straight groove cut in piston 67. It should be remembered that the pressure air is always at a pressure level appreciably higher than that of either compressed air or combusted gas.

The manner in which motor 30 is connected to other members of the engine is illustrated in FIG. 5. The compressor 90 that is used for providing the high pressure air is shown separated from the motor and driven by shaft 91 which is driven by shaft 51 of the motor. Compressed air flows to storage-tank/heat-exchanger 95 from which a small fraction is diverted to supply the high pressure air compressor. High pressure air is delivered to both free-piston combustion member (combustor) 100 and motor 30 for supplying air cushions.

The bulk of the compressed air in tank 95 flows to air inlet valving means 101 so as to be admitted in either combustion chambers 102 or 103 formed by piston 104 that reciprocates in sleeve 105. Free piston 104 is guided in its motion by central hollow shaft 106 and supported by high pressure air cushions. Combusted gas is delivered through outlet valving means 107 back to a section of tank 95 where heat can be exchanged between cooler compressed air and said combusted gas. Combusted gas is then delivered from tank 95 to motor 30. The control system used to adjust engine shaft power is not shown here. It is fully described and discussed in my cited U.S. Patents, and so are the construction and the operation of the free-piston combustor. The subject of the present disclosure is limited to the use of rotary piston motors and control thereof in conjunction with that of combustion systems utilizing a free-piston (cf. details at the end of this section).

Figure 6:
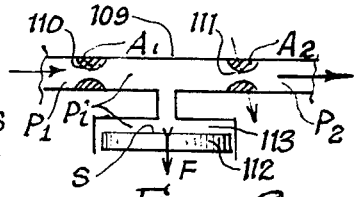
FIG. 6 is a schematic drawing showing how two restricting orifices are mounted in series for adjusting an air pressure.
Figure 7:
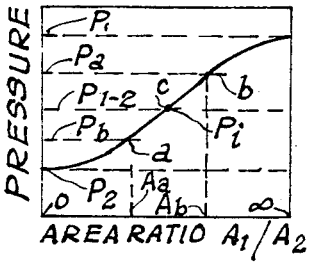
FIG. 7 is a graphic representation of the air pressure variations obtainable with the orifice arrangement of FIG. 6.

Although the principle used in the construction and operation of air cushions working in opposition is fully described and discussed in the references cited, it is summarized here again for convenience sake. The graphic and schematic diagrams of FIGS. 6 and 7 illustrate the principle. FIG. 6 indicates how two restricting orifices 110 (fixed size of area $A_1$) and 111 (variable size of area $A_2$) mounted in series in a common duct 109 may be used to adjust a pressure $P_i$ therebetween. Said pressure is applied onto piston 112, free to slide in chamber 113. Pressure $P_i$ applied on area S of piston 112 exerts a force $F=P_i \times S$ if the pressure applied on the other side of piston 112 is negligible. Conversely, if a mirror-image system is installed on the open side of piston 112 and is caused to develop a force F' corresponding to a pressure $P_i'$, piston 112 is subjected to a force $\Delta F=F-F'$ that will cause piston 112 to move. If the axial displacement of piston 112 is related to the size variation of orifice 111 and if pressures $P_1$ and $P_2$ are maintained constant, it is obvious that if the feedback loop has the proper negative corrective influence, a single position of piston 112 exists for which $P_i=P_i'$ and piston 112 settles in a stable position.

The graphic representation of FIG. 7 shows how $P_i$ varies between $P_1$ and $P_2$ as a function of the variable ratio $A_1/A_2$ as $A_2$ is caused to vary from 0 to $\infty$. Practically, $A_2$ is allowed to vary between values $A_a$ and $A_b$ corresponding to points a and b of the $P_i$ curve. If the air velocity in both orifices remains subsonic, the segment a-b is approximately linear. $P_i$ thus may vary between $P_a$ and $P_b$. If two systems such as that shown in FIG. 6 are installed in series and forced to operate between a source of air pressure $P_1$ and an air sink at pressure $P_2$, the first system will operate between pressures $P_1$ and $P_{1\text{-}2}$, and the second system will operate between pressures $P_{1\text{-}2}$ and $P_2$, as is later described and discussed when and as applicable.

The drawings and schematic diagrams of FIGS. 8 and 9 may now be related to those of FIGS. 2, 3 and 4 with the understanding which the principle illustrated in FIGS. 6 and 7 provides. One rotor assembly is used to describe the air cushion centering system. The high pressure air is introduced by means of duct 115 located inside shaft 51. Distributions ducts such as 116 connect main duct 115 to collection ducts 117 which feed ducts such as 118, one for each air cushion pad, and also playing the role of fixed size restricting orifice. A plurality (six or more) of such air cushion pads such as 119 are distributed about the periphery of journal 54 as indicated on the right side of FIG. 2 and in FIG. 9. Each air pad 119 is formed by a shallow cavity bounded and defined by: (1) the inner cylindrical surface 120 of rotor 35 central bore, (2) the bottom 121 of said cavity, (3) surfaces 122 of walls 123 which separate the cavities, and (4) inner surfaces such as 124 of the "cheek" walls such as 125 (FIG. 2).

Each cavity or air pad is open through the play or clearance $\delta$ formed between surface 120 and surface 126 that corresponds to the cheek wall and walls 123 outer diameter. If surfaces 120 and 126 are concentric, the area of each air pad variable size orifice is $\eta D\delta/n$, if n is the number of air cushion pads for that journal. At this juncture, some high pressure air must be ducted to the interfaces between rotor 35 faces and the cooperating surfaces of the restraining and guiding flanges. This may be done along two basic approaches: (1) some air is bled from air pads 119, or (2) high pressure air is directly ducted through air cushion pads 119. The first approach is shown in FIGS. 2, 8 and 9. The second approach is depicted in the drawing of FIG. 11 and is described later.

A plurality of bleed holes such as 127 distributed around the rotor central bore connect the air pad cavities to a collecting duct 128 located inside rotor 35 structure. Duct 128 supplies a plurality of radially-oriented ducts 129 which in turn connect with holes 130 that extend from one rotor face to the other. Each branch of the "T" made by a duct 129 and a hole 130 houses a fixed size restricting orifice 131 which supplies air to an air cushion pad such as 132, again prime indices are used to refer to the corresponding symmetrical part. FIG. 3 indicates that six such pads are located on each of rotor 35, as an example. The air pads located on an opposite face may be located in direct opposition or positioned in a staggered fashion therewith. In the drawing of FIG. 4, a nominal clearance or play $\epsilon$ is shown between the rotor face and the cooperating flange surface. In this first approach design, the pressure in collecting duct 128 is approximately the average of the pressure existing in air pads 119, on account of the averaging effect which the large number of small holes 127 has. The advantages and drawbacks of this approach are discussed in the next section.

A preferred design of the second approach is illustrated in FIG. 11. In that case, each air pad 119 is divided into two air half-pads 119' and 119'' along the plane of symmetry of rotor 35 half-way between the two faces. Duct 118 supplies high pressure air to he half-pads by means of holes 118' and 118'' which contain each a restricting orifice 133 (or 133'). However, duct 134 connects duct 118 directly to space 135 which is then pressurized to the full high pressure of the air. Duct 136 connects that space with hole 130 equipped with restricting orifices 137 and 137' for providing air to pads 132 and 132'. Space 135 is annular in shape and extends around the journal shaft. It has a cross-section as shown in FIG. 11 in order to seal space 135 and accommodate the relative displacements $\delta$ of surfaces 120 and 126. The construction and operation of this type of sliding-lip seal are discussed in the next section.

The operating requirements of the air cushion pads of the cylindrical journals and of the planar air pads are very different. Rotor 35 faces are subjected to side loads of only small magnitude as no major differences in pressure can ever develop between two rotor faces. In addition, a considerable amount of area is available on each rotor face for air pads. The opposite is true in the case of the cylindrical journals. A smaller area is available and the escape path of the air out of the pad cavities is necessarily short. But, more importantly, the loads which these journals must absorb are highly variable. These loads correspond to the pressure applied on the rotor side curved surfaces. These pressures vary considerably, from ambient atmospheric pressure to many times that. Those variations are far from being as brusque as those generated by the explosions which occur in a Wankel engine. Thus it seems that as much area as possible must be made available for each cylindrical journal with the maximum amount of adjustable pressure also being made available. A selection between the first and the second approach cannot be made without some quantitative comparison. This is discussed in the next section. The sectional view of FIG. 2 drawing also indicates that a cylindrical body 140 is made part of shaft 51 and is located between the two inner flanges of the motor two stages.

This cylindrical body can have a diameter almost as large as the distance separating the facing surfaces of seals 36 and 37. Both faces of body 140 are equipped with air cushion pads such as 141 and 142. Similarly, the outer cylindrical surface of body 140 could be equipped with a plurality of air cushion pads such as 143, shown in phantom lines, though these would be of little help. However, air cushion pads 141 and 142 can absorb a considerable amount of side thrust exerted along the axis of shaft 51, if and when required.

Seals 36 and 37 are assumed to be constructed and to operate in a similar fashion. Seal 36 has little utility if the expanded combusted gas leaves the motor at a pressure only slightly above atmospheric pressure. It will be assumed here that further expansion is performed in a supplementary stage, as earlier mentioned. In such case, it is preferable to prevent introduction of combusted gas in the fresh air admitted in the compression chamber. A cross-sectional view of seal 37 is shown in FIG. 10. A cross-sectional view of seal 36 would be a mirror image thereof.

The seal structure includes a straight flattened section of what resembles a racing bicycle tubeless tire. This section has a constant cross-section and extends from the inner surface of flange 32 to the inner surface of flange 33 and is kept under a small amount of compression thereby. The inner surface of shell 31 wall is shaped to form a straight dimple-like depression 151 in which the thick wall portion 152 of the seal fits. It is held by a plurality of hollow-stem rivet-like fasteners 153. The flat heads 154 of these fasteners clamp seal portion 152 in place. Air under pressure is supplied through holes 155 inside the seal. The pressure urges the thinner outer portion 156 of seal 37 to bulge outwardly. However, part of thin-walled portion 156 is continuously being pressed on by either part of one curved surface of the rotor sides or an apex generatrix, as shown by phantom lines 157 or 158. The apex is represented pushing in the seal thin wall deeper than a curved side surface does, as indicated by the two parallel phantom lines which represent the local deformation that the seal experiences. Examining the schematic drawing of FIG. 1 reveals that the transition in an apex position from line C (ready to engage seal 37) to line E (apex located at the midlocation of seal 37) is progressive and results from a combination of translation and rotation movements of the apex.

As already mentioned, the rotor curved side surfaces never slide on the inner surface of shell 31 wall, except at the seal locations. However, the rotor apex lines are constantly in sliding contact with said surface and/or the seals. Theoretically, this is only a line contact but of a critical nature, especially in the case of the present invention where the rotor is allowed an additional degree of off-centering freedom by the amount of $\delta$. Therefore, some flexibility must be introduced in the construction of the tip of the rotor lobes, if binding, uncontrollable friction and/or excessive leakage are to be avoided. Three typical approaches to "flexible" or conforming apex sealing are illustrated in the drawings of FIGS. 12–14. The first is based on the formation of a "sheet"-shaped jet of high velocity air emerging from and along the apex line (FIG. 12), the second is centered around the use of a sliding seal bar pushed by air pressure (FIG. 13), and the third utilizes a tiltable self-centering conforming sealing pad (FIG. 14).

In the seal construction shown in FIG. 12, high pressure air is ducted through radially-oriented hole 160 to transversally-oriented hole 161 which feeds a plurality of holes 162 opening into space 163 that extends the length of bar 164 which is pressed in slot 165 which extends from one face of rotor 35 to the other. The pointed right end of bar 164 contains a narrow slot 166 along its full length. A plurality of small holes connect space 163 to slot 166, these holes having a diameter much larger than the width of slot 166 so as to cause the end of slot 166 to act as a discharging nozzle. In the illustration, the curved side surfaces 46 and 48 of lobe 47 are represented fixed and the relative extreme positions assumed by the inner surface of shell 31 wall are depicted by phantom lines 167 and 168. Phantom line 169 illustrates the case where that surface is positioned perpendicularly to lobe 47 plane of symmetry. In that instance, nominally, the separation distance between bar 164 tip line and line 169 is shown as $\epsilon'$. $\epsilon'$ must be at least equal or slightly larger than $\delta$.

The sealing arrangement depicted in FIG. 13 is predicated on controlled constant sliding contact being maintained at all times with the inner surfaces of shell 31 wall and of seals 36 and 37. The compensation for $\delta$ variations, dimension tolerances and/or influence of seal wear is assured by enabling the sealing contact line to move radially with respect to lobe 47, as necessary. The prismatically-shaped body 170 extends the length of the apex line in slot 171 cut in lobe 47 so as to enable body 170 to slide radially and/or laterally as solicited. High pressure air is ducted into space 172 through radial hole 160. Body 170 bottom end is free to slide in and out of space 172 but is pushed out by the pressure existing therein. Two air cushion pads 173 and 174 are provided on each one of slot 171 side surfaces and these air pads are supplied with high pressure air by ducts 175 and 176 respectively. Each duct is equipped with a fixed size restricting orifice 177 and 178 respectively.

A plurality of holes 179 bring high pressure air to channel 180 which extends the length of body 170 prism. At each one of its two ends, channel 180 houses a fixed size restricting orifice 181 before it vents in air cushion pads such as 182 shown in dotted lines, formed in cooperation with the inner surfaces of flanges 32 and 33, and located at both ends of the prismatic body. The sliding prism is thus automatically and constantly centered laterally and transversally by the actions of four air cushion pads. The three phantom lines 183, 184 and 185 represent the three typical relative positions that lobe 47 may occupy with respect to the inner surface of shell 31 wall.

In FIG. 14, the partial cross-sectional view depicts a seal construction that allows the seal contact line to move for position adjustment both radially and angularly. To that effect, seal body 190 incorporates two wings such as 191, one central spinal web 192 and an almost-cylindrical shaft 193. All of these parts of the seal body extend the length of rotor 35 apex generatrix.

Housing cavities extending the same length are cut in lobe 47 as follows: two lodgings such as 194 contain the wings, one central slot 195 is wide enough and shaped to allow tilting of web 192, and open-ended cylindrical bore 196 radially restrains shaft 193. The diameter of bore 196 is slightly larger than the diameter of shaft 193 and the depth of lodgings 194 is slightly larger than the thickness of wings 191. These built-in plays enable seal body 190: to move freely in all directions and to keep from becoming jammed or stuck in one position.

However, three complying constraints are imposed on body 190, one for each of its three specific degrees of freedom, by means of air cushion pads: (1) two pads such as 197 located under each one of the two wings, (2) two pads such as 198 located at each one of the two ends of shaft 193, and (3) the narrow space crescent-shaped located between shaft 193 and bore 196. Duct 160 supplies high pressure air to all air pads by means of ducts such as 199 equipped with a restricting orifice such as 201 and hole 200 housing two restricting orifices such as 202. Pressure applied on the surface of shaft 193 causes the entrance to slot 195 to close, but a force directed downward of sufficient magnitude may overcome such pressure load and open an air passage between web 192 and slot 195 sides. At rest, the balancing action of air pads such as 197 causes the tiltable seal pad to align itself up with the axis of symmetry of lobe 47. In that position, the dimensionings of the pad wings are such that their external surfaces are aligned with the rotor curved side surfaces.

Figure 15:
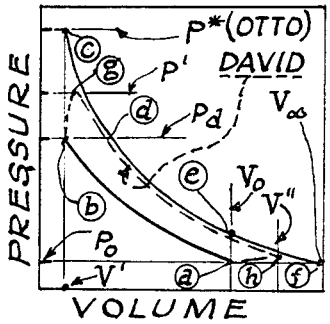
FIG. 15 is a graphic representation of the pressure-volume thermodynamic cycle obtainable with the external combustion engine of the present invention.

The curves shown in FIG. 15 correspond to a graphic representation of the operation of the external engine of the present invention. The variation of pressure as a function of volume is used to show how various thermodynamic cycles of interest may be utilized to indicate the differences which characterize the thermodynamic cycle of the subject engine—referred to as DAVID Cycle—as compared to other well known types of cycles. This is explained at length in the references previously cited. Three basic cycles are routinely used to describe the operation of internal combustion engines (IC engines, Diesel and gasoline) and gas turbines. The content of FIG. 15 is discussed in more detail in the following section. At this juncture, it should be noted that the Wankel rotary piston engine operates according to an OTTO Cycle, whereas the external combustion engine (EC engine) of the present invention operates according to a thermodynamic cycle of its own, which is theoretically conducive to obtaining higher thermodynamic efficiency, all other parameters being the same, such as compression ratio.

FIGS. 16 to 19 illustrate an alternate embodiment of an automatic valving system which has no sliding part and makes use of cylindrical body 140 acting as a rotating flange mounted on shaft 51 and numbered 220. This flange may also serve as thrust bearing, as cylundrical body 140 or be mounted by means of straight splines on shaft 51, if end bearings 52 and 53 are constructed to absorb axial loads. In any event, the angular movement of flange 220 follows exactly that of shaft 51. The rotary pistons are driven by the combined actions of the crankshaft and of gears 56 and 58 so that a given shaft angular position corresponds to a single and repeatedly unique angular position of each rotor, in the ratio of one full rotor revolution to three shaft revolutions or, because the rotor has three identical curved sides, one rotor side continuously rotating and sliding unevenly (assumed CIR or rotor center moving) during each revolution of crankshaft 51. The timing correspondence is fixed and without risk of slippage, albeit of a complex nature.

The angular motion of rotating flange 220 may thus be used for directly actuating valve 44 by mechanical means. Although neither illustrated nor further described in detail in this disclosure, readers familiar with the art will readily understand how a mechanical linkage can easily be inserted between cylindrical body 140 and valve 44 and/or a valve monitoring the operation of compressed air outlet port 41. However, because the operating temperatures of such parts is very high and NO lubrication is provided, it appears advantageous to eliminate causes of solid friction between components of the valving means.

To such an effect, flange 220 is given a diameter larger than that of cylindrical body 140 so that the peripheral portion of the flange may be used as a gaseous fluid valving distributor. This distributor flange is kept centered between inner flanges 33 and 33' of two contiguous motor stages by means of air cushions 141 and 142. External structural ring 31'', also larger, is equipped with connection bosses 221 for accommodating duct 223 to channel combusted gas (as indicated by the arrow) or compressed air (in a direction inverse of that of the arrow) if check valve 40 is not used. Duct 223 ends with port 224 which faces shaped duct 222—shown servicing the motor left stage and that would be turned 180° if servicing the motor right stage—and duct 222 makes a turn of 90° to face fixed through-channel 225. Channel 225 opens into external structure 31 which is provided with a matching vent 226. Vent 226 then opens into shaped cavity 227 which opens into chamber 228 (for expansion or compression, as the case may be). Port 229 is shaped and sized so as to support sliding seal 170 or 190, if they are used. Directing vanes such as 230 serve to facilitate fluid flow and to form supporting lands such as 231, oriented and sized as described in the cited references. Structural webs such as 232, 233 and 234 are used as reinforcing and fluid-directing vanes.

Figure 18:
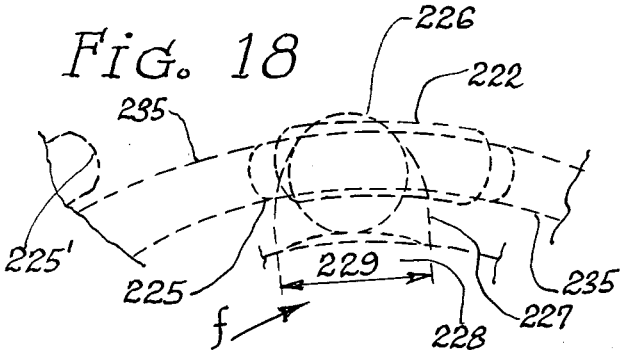
FIG. 18 is a diagram showing the second port registering.
Figure 17:
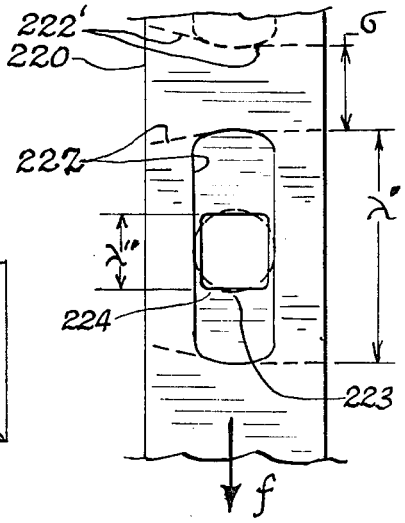
FIG. 17 is a diagram showing the first port registering.

FIG. 17 shows a portion of the developed cylindrical surface of rotating flange 220 illustrating how curving duct 222 registers with square-shaped port 224, the outline of duct 223 appearing in phantom lines for reference. Also shown in phantom lines as 222' is the end of an outline of the compressed air exit port, if present. In FIG. 18, the registering of the other end of duct 222 with the opening port of through-channel 225 is depicted with an outline of vent 226 opening into cavity 227, also outlined in phantom lines. The "angular" width of port 229 is indicated for reference. Phantom lines 235 indicate the outline of the path followed by through-channel 225 relatively to rotating flange 220, although channel 225 is of course fixed. If automatic valving of the compressed air is used, the radial location of channel 225' is farther out than that of duct 225, beyond line 235 so as to avoid interferences.

To minimize combusted gas and air leakages, the clearances $\epsilon''$ between the quasi-sliding faces of rotating flange 220 and flanges 33 and 33' is kept small, nominally about two mils. The clearance $\epsilon^*$ between rotating flange 220 and structural ring 221 OD is about the same size, material nature and tolerance matchings must be used to minimize the combined influence of thermal expansion and manufacturing tolerances. Two circular collection grooves such as 236 further serve to limit exchanges between gas and air. The grooves are vented through duct 237 to evacuation duct 238.

Figure 19:
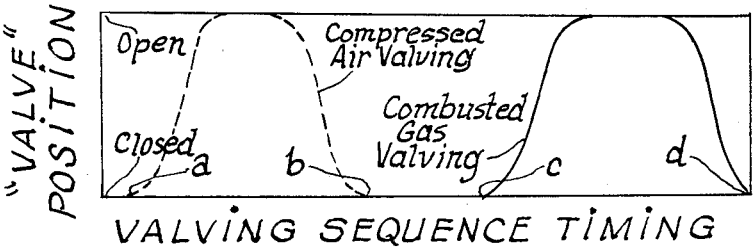
FIG. 19 is a diagram illustrating the sequence timing of the automatic valving means for combusted gas admission.

Timing indications and approximate locations of the starts and stops of compressed-air exhaust and combusted-gas admission are indicated in FIG. 1 and corespond to FIG. 19 graphic representation. The corresponding angular rotations of shaft 51 are indicated on circle Γ, locus of the rotor centers assumed here to be CIR's. Circle Γ* indicates the circular limit beyond which air cushions should not extend, except in the lobe region. 0* represents shaft 51 centerline line and 0' represents the assumed CIR or rotor center of a rotary piston in position A, used as a point of origin, and corresponding to point 0 and/or $0_1$ (reference apex line). All points located on circle Γ are shown with a' index for easy identification and recognition, and correspond to points identified without a' index on the locus of points 0 which is by definition both the external structure curved surface and the paths followed by all apex lines of the rotary piston. The reader should remember that the shaft turns thrice faster than the rotor body, but in a repetitive non-linear fashion. As the rotor apex 0 progresses following arrow f, the already partially compressed air contained in space S becomes more compressed. When 0 reaches a point between index a and index $a_1$, the rotor center or assumed CIR 0' has moved three times faster along circle Γ. The interval a-$a_1$ corresponds to arc a'-a' on circle Γ. From $a_1$ to about b location, b' on circle Γ, the compressed air in shrinking space S volume is to be exhausted through port 41. The rotor apex line passes over seal 37, rotor 35 has turned 90° and shaft 51 has already turned $\frac{3}{4}$ of a revolution. Soon after passage of arc c—c, combusted gas should start being admitted in space ϵ (expansion chamber), point c' on circle Γ. ϵ volume increases as apex line 0 moves toward a limit point d, at which time combusted gas admission must cease. However, during that time, on circle Γ, the point corresponding to the reference rotor apex has moved past 0' and shaft 51 has rotated over a full turn. At point d (d' on circle Γ), all the combusted gas for that expansion cycle must be in space ϵ. Shaft 51 has turned almost three half-revolutions.

However, when the first reference apex line $0_1$ is at point 0, the second apex line $0_2$ is beyond interval c-c and soon thereafter, e.g. when $0_2$ has passed arrow ϕ location (interval c''-0' on circle Γ), port 43 opens into space ϵ and combusted gas must be admitted before apex line $0_2$ reaches point d. Also, the exhaust of the compressed air must begin no later than the time at which apex line $0_1$ reaches point $a_1$. Furthermore, the ports of ducts 222 and 222' must not overlap, if automatic valving is provided for compressed air. Referring back to FIG. 1, one sees that on circle Γ, the ports of duct 222 may register during arc g'-g'' for combusted gas admission and ports of duct 222' may register during arc a'-b' for compressed air exhaust. An adequate separation distance along the outer cylindrical surface of distributor flange 220 is thus available between the edges of ports 222 and 222' of FIG. 17 (distance σ). The sum of the dimensions λ' and λ'' represents the duration of combusted gas admission (distance c-d in FIG. 19). Obviously, σ must be longer than λ'' to prevent air-gas mixing. The other half of circle σ is available for the ports needed for the other stage, opposed 180° by virtue of the crankshaft (position C for second rotor initial position).

Finally, three aspects of the use of a rotary piston motor in a free-piston EC engine briefly alluded to previously need some additional describing. They result from three major operating differences that exist between rotary piston motors and vane motors: (1) compression and expansion ratios of interest can easily be obtained in one stage in rotary piston motors, whereas this cannot be achieved by a single stage vane motor; (2) rotary piston motors require valving means, whereas the vanes of a vane motor automatically provide the valving functions; and (3) the volumes "displaced" by a rotary piston are theoretically equal for both compression and expansion, by construction. The practical consequences thereof are: (1) valves must be present in a rotary piston motor and may then be used to perform additional functions, (2) a single rotary piston stage can be used to compress air already compressed to a much higher pressure, and (3) the timing of the valve operations can be used to alter the effective "displaced" volume in either chamber, at will. Three implications resulting thereof are described below, although extensively discussed in the next section: (1) valve control, (2) high pressure air production, and (3) combusted gas expansion stage construction.

The power control approach used with EC engines having a free-piston combustor differs from that which is commonly used for IC piston engines, i.e. regulating either air intake or fuel injection, one of either parameter, in turn, resulting from the other. Because no direct coupling between the combustion and the motor regimes exists in such EC engine, the amounts of air and fuel admitted in a combustion chamber must be metered for each combustion cycle at a location between the storage tank and the combustor. Examplary embodiments of such control systems are described and discussed in my prior U.S. Patents (cf. cited references) as follows: (1) in U.S. Pat. No. 4,653,274 (e.g. FIGS. 23, 24, 25, 26, 27, 28, 29 and 38), and (2) in U.S. Pat. No. 4,665,703 (e.g. FIGS. 15 and 17). The schematic diagram of FIG. 5 of the present disclosure only summarizes the arrangement of the various components of an EC engine using a combination of a rotary piston motor and a free-piston combustor such as that described in my U.S. Pat. No. 4,665,703. Readers familiar with the art will easily establish the correlation between the control system needed for the present invention engine and those disclosed in the cited references. For information related to engine control, readers should refer to my U.S. Pat. No. 4,653,274.

For reasons made clear in the following section, it may be of interest to provide means for adjusting the timings of the opening and closing of valves such as 44, thereby enabling the shortening of the valve opening duration. To that effect two control shut-off valves 20 and 21 (FIG. 4) may be installed on pressurized air lines 75 and 73, respectively. The operations of these two valves are monitored by the engine control system so as to provide a signal overriding that which shuttle piston 67 generates. Valve 44 cannot open or close unless control valves 20 and 21 are open. By causing their closing, the control system is enabled to override valve 44 actuating system.

The further compressing of already-compressed air, as shown in FIG. 5, can be achieved by using an external compressor such as 90 driven by motor power shaft 51 by means of shaft 91. Compressed air is supplied by air line 90' which is connected to compressed air outlet duct 42 before the compressed air has reached heat exchanger 95. A rotary piston compressor such as 25 (FIG. 2, shown in phantom lines) directly mounted on crankshaft 51 may prove a more efficient and compact way to further compress this air. In such instance, bearing 52 is then moved and relocated on the left side of compressor contour outline 25. It should be remembered that both of the two chambers formed alternatively by the compressor rotary piston are used exclusively as compressing members, in contrast with the operation of rotor bodies such as 35. Because only 5%, or less, of the compressed air delivered by the motor is handled by the high pressure compressor, the latter requires a rotary piston size much smaller than that of rotor 35, as indicated by contour outline 25.

My U.S. Pat. No. 4,702,205 describes a conformable vane motor that is ideally suitable for the additional combusted gas expansion stage shown as 26 on the right side of FIG. 2. However, it might prove advantageous to use a rotary piston for that stage, in which case, again both chambers are used for one single function, i.e. additional gas expansion to atmospheric pressure. In such instance, the spline system 62 shown in FIG. 2 is not utilized and another eccentric journal system similar to 54 is used. A single rotor body 61 then assumes the shape and the role which are assigned to a rotor body such as 35 in the previous description. The associated valving means and operation thereof are described and discussed in considerable detail in the following section.

DISCUSSION AND OPERATION

The advantages of burning fuel externally to the motor in an EC Engine (External Combustion engine) are extensively discussed in the cited references. They are summarized here for convenience. Fuel combustion is permitted to occur much more slowly than would be the case, were it temporally tied to the motor rpm's as it is the case in IC Engines (Internal Combustion). In addition, the motor air-compressing portion is functionally divorced from the combusted-gas-expanding portion, because the transformation of compressed air into combusted gas is performed outside of and mechanically independently from the motor, as is the case in a gas turbine. The end results can best be illustrated by means of a graphic representation of the thermodynamic cycles involved in a Pressure/Volume diagram, as shown in FIG. 15.

As references and for comparison purpose three well known cycles are depicted and normalized to the same values of volumes and pressures. Cycle a-b-c-e-a corresponds to the OTTO Cycle of a gasoline engine. Cycle a-b-d-e-a corresponds to a DIESEL Cycle. Cycle a-b-c-d-f-a corresponds to a Brayton Cycle or gas turbine engine. Cycle a-b-g-h-a corresponds to the optimum type of the DAVID Cycle of the present invention. The areas of quasi triangles b-c-d and a-e-f represent the basic differences between the three reference cycles and correspond to a gain or a loss of thermodynamic efficiency, as the case may be and as a thermodynamicist knows, provided that compression ratios are identical, though not practically the case for Diesel engines. Optimally, the DAVID Cycle is characterized by two quasi triangular areas b-g-d and e-h-a which both correspond to an efficiency gain. The cited references explain why and how such gains are potentially possible with the DAVID Cycle. For the purpose of the present disclosure, suffice it to indicate that providing the means for materializing triangles b-g-d and e-h-a is one of the aims of the construction and operation of the embodiments previously described.

Triangle b-g-d is obtained by a combination of synchronized and coordinated operations of the free-piston combustor and of the engine control valves. This matter is extensively covered in the cited references. However, triangle e-h-a results directly from the construction of the motor embodiment. It corresponds to an expansion of the combusted gas which is more "extensive" than the compression of the air used to burn the fuel—case of a gas turbine. This is impossible to achieve with piston and/or rotary piston engines because the piston displacements must necessarily be the same be it for air compression or gas expansion, if the fuel combustion is to take place during that almost instantaneous period of time when the piston is at the end of its compression stroke (case of an OTTO Cycle). However, if fuel combustion is physically removed therefrom, that constraint is also removed as is the case herein. Those construction features which enable the present invention embodiment to take full advantage of such possibility are discussed hereinafter, as applicable.

Removing the combustion process from the motor confines provides another opportunity, especially in the case of an OTTO Cycle mode of engine operation in which an explosion actually happens: i.e. that of eliminating the brusque and high pressure rise that occurs in the combustion chamber. This happens at or in the vicinity of the dead point of the crankshaft motion. The brusque increase in loading of the crankshaft journal concommittant therewith mandates the use of oil-cushioned bearings. If and when such brusquely varying loads are dispensed with, the possibility of utilizing other types of journal bearings offers itself. Lateral guidance and restraint of the rotor bodies or pistons are even easier to achieve. Eliminating the presence of lubricating oil opens up a gamut of possibilities which result in compounded benefits, the elimination of wear being the foremost if mechanical contacts between moving parts are prevented. The description of air cushioning for constraining the rotor bodies previously given is specific enough to indicate that special design and manufacturing aspects of the preferred embodiment herein need now be discussed in detail.

CLEARANCES, TOLERANCES AND PLAYS BETWEEN PARTS

Air cushions cannot operate without relative displacements being tolerated between the parts to be kept separated. On the other hand, seals located between such parts must either prevent the passage of compressed air and/or combusted gas or control leaks thereof which cannot be stopped or are deemed acceptable. In addition, some parts must be kept in quasi-fixed relative positions or have their relative displacements adequately accommodated: e.g. the meshing gears of the moving rotor and of the fixed flange. In either event, it is of interest to control, limit the extent of and/or provide for automatic adjustments of such relative displacements. The effects of thermal expansion of parts must also be considered and minimized or neutralized.

Another limiting consideration is the amount of high pressure air that is expended for operating the air cushions. If that amount represents to high a percentage of the compressed air, an excessive energy loss results. It is caused by two compounding factors: (1) the amount of compressed air diverted does not produce the energy that it should as subsequent combusted gas, and (2) the amount of energy expended for further compressing that air is drawn off the motor shaft power and mostly lost. The static operation of an air cushion is theoretically independent of the size of the restricting orifices used for the control thereof. The dynamic aspect of such operation may be ignored at this point. A smaller size orifice obviously means a proportionately smaller air flow, everything else being kept equal. The high pressure air may be filtered so that the size of solid particles therein may be ignored. The separation distance between the two mobile surfaces determining the area of the variable size orifice could theoretically be as small as a fraction of a mil (one thousandth of an inch). Practically, it is of course not so. However, it is of prime importance to determine first what a realistic clearance between the rotor bore and the crankshaft journal land could be, being the most critical item as will become apparent later.

First, examining the drawing of FIG. 2 reveals that crankshaft 51 can be made very strong and rigid. It is laterally constrained at both ends by conventional bearings 52 and 53. The box type of structure formed by flanges 30, 33, 33' and 32', and external structures 31,31' and 32'' may be assumed to be very rigid and strong. Thermal expansion of these parts, if any, can be assumed to occur around the axes of bearings 52 and 53 and should not affect the crankshaft positioning. The rotors are free floating and adjust their mean radial locations around the crankshaft journal lands (journal ID). Differential thermal expansion between the journal ID and the journal OD (rotor bore diameter), results from a difference in operating temperatures between the rotor and the crankshaft and from the difference between their coefficients of thermal expansion. A proper matching of materials can practically eliminate this factor, as discussed later.

The last two factors remaining are the manufacturing tolerances on these two dimensions which are unavoidable and the amount of play that must be provided to allow for the dynamic behavior of the rotor in response to soliciting pressure side loads. These result from the piston-like action which the rotor body is urged to adopt and are transmitted to the journal directly. As earlier mentioned, they are applied progressively but vary temporally in a pulsating manner. The mass of the rotor body is thus subjected to an exciting force function, said force being resisted by the counteraction of the air pads. However, such counteracting action cannot come into play until and unless a relative radial displacement rotor/crankshaft occurs first. An oscillating system thus is created but, fortunately, is not given the opportunity to initiate any lasting oscillation, because the rotor continuously changes its position and orientation. However, the rotor mass should either respond fast or slow compared to a given time yardstick, such as the angular speed of the crankshaft. If the response is fast, the rotor radial displacement is small because the journal air pad reaction is caused to be quick. If the response is slow, the rotor radial displacement is also small because the rotor has moved about appreciably during the response time.

Everything else being equal, the rotor response can be made faster by lightening the rotor body and minimizing the volume of the air pad cavity. Conversely, the rotor response can be slowed down by increasing the rotor weight and enlarging the air pad cavities. The rotor weight cannot probably be adjusted by more than a factor of three. The volume of the air pad cavities though can easily be varied by a factor of five to ten, by adjusting the cavity depth—0.016 to 0.125 inch for instance. Combining these two factors gives the designer a considerable latitude—a combined adjusting factor range of 1 to 25. It will be assumed that a maximum rotor radial excursion may thus be limited by design to 0.75 the value of $\delta$ of FIG. 9. Other considerations may force the designer to elect an adjustment in one direction rather than in that which may seem more logical at this time. In any event, $\delta$ should probably be kept at the most minimal value possible.

That minimum value must be equal to half the sum of: (1) the tolerance on the journal ID, (2) the tolerance on the journal OD, (3) the maximum excursion, and (4) a small amount corresponding to the maximum differential thermal expansion that can be expected. The journal ID and OD can be manufactured within half a mil and matched. A total of 0.001 inch can be assumed for (1) and (2). A maximum excursion of 0.002 inch should suffice for (3). The maximum differential thermal expansion could be kept to less than 0.001 inch. A mean value of 0.0025 inch for $\delta$ appears realistic enough, yielding rotor radial excursion maximum amplitudes of 1.5 mil to 2 mils. This means that the radial displacements of the rotor pistons could be kept very small, although still large in comparison with the amount of play which bearings such as 52 and 53 are restricted to—a fraction of a mil. Thus for the purpose of this discussion, the rotor body and its internally-cut-tooth gear 58 are free to rotate about the crankshaft and become off-centered with respect to shaft 51 centerline by as much as 2.5 to 3 mils in any radial direction. The meshing of the teeth of pinion gear 56 with those of gear 58 would then be considerably less than ideal if steps were not taken to remedy the situation. Design solutions are discussed later in this section.

As an example, a diameter of 3 inches will be assumed for the crankshaft journals. The nominal area of the variable size orifice corresponding to $\delta$ is then about 0.032 sq.in.. Assuming that the journal has eight air pads, the area of a fixed size restricting orifice such as 118 of FIG. 9 should be about 0.004 sq.in. This corresponds to a diameter of about 1/16-th of an inch.

The other air cushion pad system which restrains the rotor piston consists of two set of air pads, one set for each flat face of the rotor. The loads applied on the rotor in an axial (or lateral) direction are of much smaller magnitude, an almost negligible fraction of those previously considered. All of the pads on either rotor face exert forces applied in the same direction and their use is also more efficient than that of the journal air pads. The width w of these pads could and should therefore be reduced to a minimum value so as to enable the designer to maximize the journal diameter—which is critical—for a given rotor size. Using the previous 3-inch value for that diameter, the total area of the side air pads is roughly $\eta\ w(3+2w'+w)$ if w' is the dimension shown in FIG. 3. It is at leat equal to 0.4 inch. Assuming that w will be less than $\frac{1}{4}$-inch, one may approximate the total pad area at 13 w. The length of the air escape route out of these air pads is about 25 inches.

It is reasonable to assume that the thicknesses of the external structures and of the rotor pistons could be matched within $\frac{1}{2}$ mil. The differential thermal expansion between those parts should remain below 1 mil again. Thus, the separation distance $\epsilon$ of FIG. 4, or variable size orifice gap, could again be maintained at a nominal value of 2 to 3 mils. The area of the variable orifice is then about 0.0625 sq.in. or twice what it is for the journal air pads. The fixed size restricting orifice such as 131 has a diameter of 3/32-nds of an inch if it is used in conjunction with an air supply system as shown in FIG. 2. If the sealed air channelling system of FIG. 11 is used, the size of the corresponding orifice such as 137 must be considerably less, as discussed later in this section.

The magnitude of the forces laterally-applied on the rotors varies as the rotors rotates. These forces are created by the reaction of gear 58 which is forced to stay engaged with pinion 56. This reaction is applied at the contact point between the gear teeth, in a direction off-centered with respect to both the journal axis and the rotor piston central plane of symmetry. The contact point of course revolves around the journal. The component part of the reaction perpendicular to the journal axis generates the torque that urges the rotor piston to rotate around its journal. The component part of the reaction that is caused to be off-centered with respect to the central symmetry plane produces another torque which tends to make the rotor body rotate about an axis of instantaneous rotation that is orthogonal to the journal axis and the orientation of which continuously rotates about the journal axis. This results in a "twist-like" action exerted on the rotor body. It is reacted by both the journal and the side air pads. However, the journal air pads shown in FIG. 2 are ill-conceived to create such type of reaction. The construction depicted in FIG. 11 is much better conceived for such a task, as a reader familiar with the art will easily understand. In either case, the bulk of that reaction should be provided by the side air pads that are much better configured to accomplish this task. The optimum thickness T of a rotor body being between half and two thirds of the journal diameter, one can easily see why one should rely on the side air pads for such task. The corollary is that the side air pads should be given an opportunity to act before the previously assigned function of the journal air pads is noticeably affected. For that reason alone, it is important that the nominal value of $\epsilon$ be no more, and hopefully less, than the value of $\delta$, everything else being the same.

The magnitude of these side loads is difficult to assess and they would not even exist if a second pinion gear were mounted on the other flange 33 wall for engaging a second internal tooth gear mounted on the other side of the rotor. For the time being and for the purpose of this disclosure it is assumed that the side reactions required of the side air pads are less than 10% of those which the journal air pads must exert.

AIR CUSHION PAD PRESSURIZATION

Enough information is now available to determine the levels of the nominal air pressure which are required by each type of air pads. Provisionally, the following dimensions in inches are assumed: journal diameter 3.0, w—0.2, average diameter of the circular contours of the side air pads 4.0 and width of a journal 1.5. Using the ratio of 10% previously mentioned and assuming that: (1) half of $P_1-P_2$ is exerted on the journal at the end of an excursion on an effective area equal to 2.0 sq.in., (2) a pressure differential $\Delta P$ is applied across the rotor piston between two air pads operating in opposition at the end of a lateral excursion, and (3) only 70% of the air pad total area is effective. A relationship between pressure levels may be established as follows: $2(P_1-P_2)/2=\eta\times4\times0.7\times0.2\times\Delta P$.

The ratio $(P_1-P_2/\Delta P$ is then roughly equal to 1.8. Referring to the graph of FIG. 7, $P_1$ represents the constant high pressure existing in collecting duct 117 and $P_2$ represents the maximum of the air or gas pressure existing in any space inside the motor into which any and all air pads vent. $\Delta P$ is equal to an elevated air pressure higher than $P_2$ and lower than $P_1$ which is referred to as $P_{1\text{-}2}$ shown equal to $P_i$ (point c) for the sake of simplicity, although not necessarily the case, and is $P_{1\text{-}2}-P_2$. For convenience, a practical constant value can be assigned to $P_2$, e.g. 200 psi. The previously derived ratio of 1.8 quoted above thus means that $P_{1\text{-}2}=(P_1+160)/1.8$ expressed in lbs/sq.in. or psia (absolute pressure, referred to herein as psi). It should be noted at this point that this relationship holds for w=0.2 and the 10% value of the lateral/radial load ratio earlier assumed as being an upper limit. Increasing w and lowering that ratio both contribute to decreasing $P_{1\text{-}2}/P_1$.

The constant regulated value of $P_1$ should now be determined. It results from the consideration that the journal action must oppose the combined action of compressed air and combusted gas on one curved side of the rotor piston when in the position referred as B in FIG. 1. Generally speaking, the projected effective area of the rotor side curved surface on which such pressures are applied is about five times the projected effective area of the journal. It follows that $(P_1-P_2)$ must be roughly seven to ten times the average of the peak pressures of compressed air or combusted gas, assumed to be equal to $P_2$ now, for the sake of convenience. This indicates pressure levels of roughly 1,500 to 2,100 psi for $P_1$ and 900 to 1,200 psi for $P_{1\text{-}2}$. Such levels are high and easy to generate, however, the pressure ratios across the various restricting orifices—of fixed or variable size alike—are such that sonic velocity is reached at least in one of these orifices mounted in series or in both in some cases. Such conditions of sonic velocity introduce two considerations worth mentioning: (1) the total air flow is limited by the sonic flow condition in the orifice, and (2) the shape of the curve of FIG. 7 graph is somewhat affected. However, the operation of the automatic control system of the rotor piston positioning remains basically unaffected. The numerical derivation above is highly conservative and it seems that lower pressure levels should be adequate because of the rapid transient nature of the load applications and the inertia of massive parts such as the rotor pistons. Further elaboration of the "averaging" influence of such aspects of the dynamic behavior of the rotor is clearly beyond the scope of this disclosure. Suffice it to stress the importance of minimizing the sizes of the two types of clearances previously discussed.

Using data previously generated and reported in the cited references, it is estimated that the loss of engine efficiency or equivalent rise in specific fuel consumption resulting from the generating and then venting of the high pressure air correspond to those gains which are derived from heat exchanging and improved combusted gas expansion, using the Mazda Rotary Engine as a basis for comparison. The reader should remember that the main object of the present EC Engine is not especially to save fuel per se, but to eliminate or minimize lubrication and wear, and to minimize the production of pollutants while burning lower grade fuels.

The further compressing of already compressed air needed to generate the high pressure air can be done by an externally located compressor as shown in the schematic diagram of FIG. 5 or by means of an additional scaled-down rotor piston using its two "strokes" for compression, outlined in phantom lines such as 23 and 25 of FIG. 2. Both approaches offer advantages and have drawbacks. A preferred construction cannot be identified at this juncture. However, the manner by which this compression is performed does not affect the basic mode of operation of the engine of the present invention. Not shown in FIG. 5, are two basic components installed between compressor 90 and the delivery points of the high pressure air to the motor and the free-piston combustor: (1) an air filter, and (2) a small high pressure air tank.

ROTARY PISTON GEAR DRIVE

It was earlier determined that a rotor body restrained exclusively by air cushions must be given the freedom to translate or/and oscillate—and/or concurrent combinations thereof—within the narrow limits defined above. However, during these small amplitude displacements, the rotor piston must mechanically engage a fixed gear by means of another rotor-mounted gear. Furthermore, the torque transmitted by these two gears varies and even reverses itself. It is believed that, under such operating conditions, gears which do not properly mesh could not perform satisfactorily for an appreciable amount of time. Thus some degree of flexibility and/or position conformability must be provided between the two gears. Means for providing this may be mounted on either gear or on both.

The simplest construction provides for mounting pinion gear 56 on supporting structural flange 29 by means of a spring-actuated double-slider (or OLDHAM-type) coupling. Such couplings provide for torque transmission whilst allowing for some centerline misalignment. Neither axial nor angular displacements are required here, which is compatible with the use of such coupling. The amount of radial displacement is only a few mils. Spring loading within the coupling is needed to insure that pinion gear 56 follows gear 58 in its minor radial displacements off its nominal position. The angular direction of such radial displacement adjustment needed to compensate for the backlash caused by the misalignment of the gear axes happens to be almost perpendicular to the reaction exerted by the rotor gear teeth on the pinion gear teeth. This means that the spring loading earlier mentioned may be of a magnitude appreciably lower than that of the force which corresponds to the torque being transmitted between the gears.

Allowing for the angular misalignment of the gear teeth caused by the rotor minimal freedom to oscillate may be provided by giving a very slight curvature, orthogonally to the tooth normal curvature, to the rolling faces of gear 58 teeth so as to eliminate the need of extra tooth engagement backlash. Such curvature may be provided by means of an additional tooth grinding operation performed after the cutting of the gear teeth. As the reader will readily realize, providing automatic compensation for random misalignment of meshing gear teeth might be too high a price to pay for the advantages offered by air cushioned journal bearings. Another approach is described and discussed hereunder.

ALTERNATE ROTARY PISTON GEARING AND JOURNAL BEARING EMBODIMENT

In the discussion above, the matter of lubricating the gears was not raised. The extent to which operating such gearing arrangement dry would limit the gear lives is not known. Such unknown but vital espect of the gearing operation can neither be ignored nor properly conclusively analyzed. Therefore, it appears that limited lubrication may be required. In such case, using lubrication also for the journal bearings seems logical since it automatically provides a solution to the problems created by the radial freedom which air-cushioned journals necessitate. Utilizing conventional types of bearings between the crankshaft and the rotor eliminates: (1) "twist" oscillating behaviors of the rotor, (2) radial displacements of the rotor, and (3) the need for very high levels of air pressurization. It provides: (1) some cooling for the rotor, (2) cooling and lubrication of the slip seal lips 139, (3) radial and torsional restraint and guidance for the rotor, (4) ample lubricating means for the gears, and (5) means for lowering the losses caused by the venting of high pressure air. It can easily be made compatible with the use of air cushions for lateral restraint of the rotor body.

To that effect, two types of bearings can be used: (1) lubricated cylindrical journal bearings, and (2) roller bearings. For both constructions, one half of each one of such bearing is positioned on both sides of seal 139 of FIG. 11, in spaces identified as 119' and 119" and previously allocated as spaces for the air pads. Roller bearings are acceptable because brusque explosive-like loadings are not present. They also provide the tightest radial and oscillating restraints of the rotor and can be constructed to allow some axial freedom. Journal bearings require a very small amount of clearance between the journal ID and OD, possibly one fifth of what an air journal requires.

In either cases, lubricating oil is introduced in spaces 119' and 119" as high pressure air is when air-cushioned journals are used. Oil under pressure is brought by means of channels in the crankshaft located parallel to the high pressure air channels as previously described and discussed, as is well known in the art. The major difference is that ducts 118 and 134 communicate directly, and that ducts 118' and 118", and orifices 133 and 133' are no longer needed for air. Oil escapes on both sides of the journal into spaces 148 and 149 of FIG. 2. From there, it is evacuated through holes in crankshaft 51 and drawn along by the air vented from the rotor side air cushions. Although neither previously mentioned nor shown, such ducting of the "used" pressurized air is always needed and provided. Air evacuation may also possibly be accomplished by means of channels located in flanges 32, 33, 33' and 32'. Through proper channelling and by centrifugating action, oil is splashed onto gears 56 and 58 to provide the needed gearing lubrication.

CRANKSHAFT/ROTOR JOURNAL SLIP SEAL

Slip seal 139 is needed for journal constructions which require ducting of high pressure air fom the crankshaft directly into the rotor and in which air cushioned journals are not used. The seal mode of operation and material are different for each construction, albeit the size and shape of the seal could be the same in both cases. Each seal type is discussed separately.

SLIP SEAL FOR AIR-CUSHIONED JOURNAL CONSTRUCTION

The seal operating temperature is high and no lubrication of the lip/journal-bore contact area is provided. The pressure differential across the lips is about 1,000 psi and lip radial deformation occurs continuously, e.g. several mils hundred times/second. The air pressure existing in inner space 135 could be up to 2,000 psi. A minimal amount of air leakage across the seal is however acceptable. In this arrangement, two extreme possibilities are offered as well as all possibilities therebetween: (1) keep width w equal to 0.2 in. and make the areas of orifices 137 and 137' roughly half those of orifices 131 and 131', or (2) adjust the width w down to 0.1 in. and let the sizes of orifices 137 and 137' be about the same as those of orifices 131 and 131'. Another possibility exists: i.e. use an intermediary restricting orifice 138 in duct 134 (FIG. 11) so as to bring the air pressure in inner space 135 down to approximately the average pressure level which is obtained with the construction shown in FIGS. 2 and 9. In such instance, the pressure differential across the lip contact is only a fraction of that which continually exists for possibility (1) above. Only testing could establish which design approach is best. The following applies to both designs.

The material preferred for such application is carbon-fiber-reinforced graphite. The general fabrication and structural constitution of that flexible high strength material are described and discussed in the references cited earlier. In summary, the seal lip structure consists of thin layers of high strength carbon fibers laid on the bias and bound by a matrix of densified graphite. The layers are free to slide against one another so as to provide flexibility. The assembly is molded together so as to result in a monolithic structure consisting of concentrically arranged quasi-rings forming a spiral that may be wrapped around the annular cavity shaped to receive it. Graphite provides dry lubrication of the sliding contact with the rotor piston bore.

SLIP SEAL FOR CYLINDRICAL JOURNAL BEARING CONSTRUCTION

As earlier discussed, in this hybrid embodiment, partial lubrication of the journal bearings, and of the gears, is contemplated. Generally, the seal contact is lubricated, very small or no radial deformation of the seal lip occurs, the seal lips are better supported, the seal is cooled by the lubricating oil, the seal lip contact surfaces are cooler and the axial displacements of the rotor bore surface may be slightly smaller than those corresponding to the previous construction.

The seal operational requirements being much less stringent in this instance, materials such as high temperature flexible reinforced silicone composites may be used. The air pressure existing inside space 135 is several hundred psi's. The oil pressure applied externally to the seal must be kept at much lower levels so as to prevent introduction of oil in the high pressure air ducts. This happens naturally with roller-type bearings. If oil-wedge-type slip journal bearings are used on both sides of the seal, design provisions are made for channelling the return oil so as to avoid oil pressure build-ups in the spaces adjacent the external surface of the seal lips.

EXTERNAL STRUCTURE SLIDING SEALS

Two seals, one especially, must be provided between the air compression and combusted gas expansion chambers, as indicated in FIG. 1. The detail cross-section of an example construction of such seal is shown in FIG. 10. The curved side surfaces of the rotor and its apex-line seals slide against it. The shapes of the contoured surfaces of these sliding rotor parts vary from a large-diameter circle to a pointed corner. The seal structure must conform and adapt to such shape variations as they take place. For that reason, the free half of the seal structure is made flexible and is mounted so as to enable it to deform like a membrane. To that effect, this free half consists of several unbound thin layers of the carbon-fiber-reinforced densified graphite, as described above. These layers extend into the half that is clamped to and nest into the external structure inner surface recess. At a station point such as 159, the layers of the clamped half of the seal are bound together and form a rigid structure. The inner volume of the seal is pressurized with air to a pressure level slightly higher than the peak level of the maximum pressures reached by compressed air and combusted gas. Thus, the outer free half of the seal is urged to bulge out and would assume a partially cylindrical shape anchored at stations 159, were it not for the continuous presence of a constraining part of the rotor piston. The line along which contact is established between that rotor part and the seal outer surface is where sealing between the two chambers takes place. The reader will understand that, without the constraint imposed by the rotor part, the seal bulge extends inwardly into the volume formed by the external structure continuously curved surface, as outlined and defined in FIG. 1.

It is impossible to form and to maintain a continuous smooth surface between the external structure curved surface and the outer surface of the seal. The inverted cusp at a point such as 0 corresponds to a narrow groove which extends from one flange to the other. It is impossible to prevent a small amount of leakage through this groove for some positions of the rotor apex lines. That is acceptable. However, when an apex line (or its seal) passes by, such action is bound to possibly create a small jar that could excite unwanted vibrations of some parts. This potentially damaging situation can be simply remedied by orienting the seal plane of symmetry, and of the corresponding recessed cavity in the external structure, at a small angle with respect to the plane of symmetry of the external structure. Such a small accommodation causes the passage of a rotor apex line across that groove to progress smoothly from one end of the groove to the other, without jarring, the thus provided support being then uninterrupted.

In order to prevent excessive air leakage out of the seal internal volume whilst allowing for the seal conformability, provisions are made to practically seal off the ends of the seal. Two basic types of constructions are possible: (1) open-ended seals, and (2) closed-end seals. Some leakage occurs in both cases. In case (1), some air escapes out of the seal internal volume. In case (2), a small amount of leakage between the two chambers cannot be prevented. A discussion of the advantages and/or drawbacks of either design approaches cannot constructively be continued here and is not important at this juncture. The nature of these leaks is worthy of discussion, though.

In the open-ended construction, the seal is subjected to a small degree of compression, lengthwise, by the two restraining flanges. Sealing between the seal wall end edges and the flange surfaces is attempted by means of such compression. No solicitation to push the seal wall free edge away from the flange is present and the bulging out of that wall flexible membrane is continuously limited by the presence of a constraining portion of the rotor piston. A small amount of air is bound to escape at such interface. However, means may easily be provided for limiting the pressure differentials between the seal internal space and the highest pressure of either compressed air or combusted gas externally present.

In the closed-end seal construction, the ends of the unbound layers of the flexible membrane wall are formed and arranged so as to constitute an assembly of a plurality of overlapping short thin tabs separated by narrow slits and bent inwardly slightly less than 90°. These slits are arranged in a staggered position between tab layers. The ends of the tabs thus rest against the flange inner surface and provide better sealing of the seal internal space. However, the end portions of the flexible membrane are stiffer than those of a comparable open-ended seal construction. The sealing effectiveness of this construction between the two chambers may thus be impaired near the ends of the seal. However, for some engine modes of operation, minor leakage might be acceptable. Neither of these two detail constructions are illustrated, being readily understandable by the readers familiar with such art.

ROTARY PISTON SEALING

In all rotary piston embodiment constructions, sealing must be provided at the junctions of the curved side surfaces and between the side faces and the flanges. The use of air cushions implies that minimal leakage of compressed air into spaces containing combusted gas is acceptable. High pressure air escaping out of the air cushions then can be channelled in a manner such that it will prevent leakage of combusted gas into air being compressed. The drawings of FIGS. 1 and 3 may serve to indicate the locations where such leaks are inevitable.

In FIG. 1, one sees that the pressure differentials existing between two of the contiguous spaces formed between the external structure curved surface and the rotor curved side surfaces urge air and/or gas to leak around the rotor apex lines. Such leaks are either prevented by seals such as those depicted in FIGS. 13 and 14 or controlled by a seal such as that shown in FIG. 12. In FIG. 3, the locations along the rotor side faces where leaks are allowed to occur are identified by I (between adjacent air pads), II (between the air pad edges and the rotor side curved surface), and III (between the air pad edges and the rotor apex line). The nature of each type of leak and the manner in which it is either stopped or minimized are discussed below.

ROTARY PISTON SIDE FACE LEAKS

Leaks along narrow path I can be practically stopped by making the width of I a small fraction of w. Leakage along path II cannot be stopped completely, but it can be minimized by reducing its width at its narrowest point. Unwanted passage of compressed air and/or combusted gas through area III may almost be stopped by providing each air pad 132 with a narrow elongated extension such as 132" in the location indicated in FIG. 3 in phantom lines. The width of air pad extensions 132" is small enough so as to have no effect on detecting stem 49 used for controlling the opening and closing of combusted gas admission valve 44.

The shape of air cushion pads 132 shown in solid lines in FIG. 3 is given for reference only. The contour of each air pad can be modified to satisfy the design guidelines outlined above, for a given air pad area. The reader will understand that moving the center of pressure of each air pad outwardly only enhances the effectiveness of the air pads. Especially in the case where roller bearings are used between the crankshaft and the rotary pistons, the mean nominal value of gap $\epsilon$ of FIG. 4 can be reduced down to one mil. The cross-sectional area of the passages available for leaks becomes so small that such leaks may be kept down to almost negligible levels. Furthermore, in that instance, the pressure level of the elevated pressure air may be also reduced, which further reduces the high pressure air losses. Readers familiar with the art will readily understand that the air pads can be shaped and contoured so as to optimize their design.

ROTARY PISTON APEX SEALS AND LEAKS THEREBY

Three typical design approaches are embodied in the constructions represented in FIGS. 12–14. Everything else being equal, some seal constructions seem to be more suitable for specific motor constructions. The degree, amount and type of radial constraining exerted on the rotor body affects both the behavior and effectiveness of the apex seals. As an example of such seal selection and as an indication of the rationale behind it, seals of FIGS. 13 and 14 will outperform the seal of FIG. 12 when associated with a rotor mounted on air-cushioned journals, whereas the seal construction shown in FIG. 12 can operate satisfactorily as a true frictionless quasi-seal with a rotor mounted on roller bearings. Seal constructions illustrated in FIGS. 13 and 14 can provide true sealing but produce some friction, albeit to a controlled degree.

The nature of the material of the seal body is important in the cases of both seals 170 and 190 which slide on the inner curved surface of the external structure. Because the operating temperatures of such seals are rather high and friction must be minimized, and is without lubrication, carbon-reinforced densified graphite appear to be the optimum material for such application. The fabrication methods of seals 170 and seals 190 differ. Seals 170 could be cut out of blocks of the material. Seals 190 appear more fragile structurally and the reinforcements provided by the fibers embedded therein should be highly directionally oriented. Layers of matrix material reinforced with carbon fibers laid out on the bias are arranged to wrap around the core of shaft 193 to extend through web 192 and then fan out to form the wings 191. The continuity thus provided in the integrity of the fibers, albeit laid out on the bias, insures structural strength while facilitating pressurized molding or extruding of the part. The matrix material is a plastic resin compound which carbonizes under heat and pressure, can be reimpregnated and then recarbonized according to manufacturing processes well known in the art. The end result is a densified graphite matrix directionally reinforced by high strength carbon (or graphite) fibers.

Seal 170 is maintained in its sealing position by air pads and is free to adjust radially to compensate for any variation of the radial position of its guiding slot, and of the rotor, in regard to the relative fixed position of the external structure inner curved surface. Compensation for wear of the seal tip is also automatically assured. The possibility of such wear, however minimal or improbable, may be eliminated by providing seal 170 with a narrow slot 173' (shown in phantom lines) arrangement similar to that of seal bar 164 of FIG. 12. The high velocity air jet emerging at the critical corner edge of the seal would minimize the extent of the sliding contact friction just mentioned.

The apex line formed by the outer surfaces of wings 191 of seal 190 is not only allowed to adjust its radial position, but also its position (leading or lagging) with respect to the nominal position that it would have, were it not for the small amount of tilting that it is permitted. The combination of these two degrees of freedom enables the corner edge of seal 190 to let the wing outer surface do the sliding during a fraction of the rotor revolution much greater than that which seal 170 allows. Any possible wear of the corner is thus greatly diminished. Of course, a narrow slot and air jet combination could again also be provided for such seal construction.

For both seals 170 and 190, the amount of high pressure air needed for the control of the air pads can be kept small, specially and more so in the case of seal 170. The amounts of either compressed air or combusted gas that are allowed to flow by the apex line are limited according to the amount of friction penalties which the engine designer is willing to pay. Discussing the types and extents of possible trade-offs is beyond the scope of this disclosure. However, such possibility is presented by those design approaches.

Seal bar 164 is fixed to the rotor body. No physical conformance of the rotor apex line to the curved surface of the external structure is possible. No sliding contact of that apex line with said surface is permissible either. Therefore, gap $\epsilon'$ must make up for the compounding of all tolerances, clearances and $\delta$ variations. $\epsilon'$ could easily vary between a safe minimum of two mils and a maximum of ten mils, not taking into account possible thermal expansion differentials between rotor body and external structure, in the case of air cushioned journals. The penalty in amounts of high pressure air and/or of leakage is too high, the sealing effectiveness of the sheet-like air jet being questionable when it is needed most (position B of the rotary piston in FIG. 1). In the case roller bearings are used, $\epsilon'$ could possibly vary between two and five mils, if materials are properly matched and selected for the rotary piston and the external structure. Rotor position E shown in FIG. 1 corresponds to the most critical location of the seal, facing seal 37 and attempting to prevent mixing of compressed air and combusted gas. Fortunately, two favorable conditions then combine to enhance the seal effectiveness: i.e. the air jet emerges perpendicularly to the surface facing the seal and the bulging out of seal 37 flexible membrane further helps the effectiveness of the air jet.

In that instance, the penalty in loss of energy caused by the jet air flow needed for eliminating friction and controlling leakage of combusted gas (or compressed air) seems well worth it. A more detailed analysis is not justified. Referring to the cited prior art and that of gas turbines will substantiate this. Some friction is still unavoidable at the locations of seals 36 and 37. However, with the use of roller bearings, if differential thermal expansion can be eliminated by proper matching of materials, and if the maximum pressure of the combusted gas does not exceed the compressed air delivery pressure, both seals 36 and 37 could be eliminated. In that case, a truly frictionless rotary piston results, except for rolling friction—really negligible—created by the roller bearings. It is believed that the sum total of the air leaks along the rotor side faces and around the rotor body apex corners would well be justified by the elimination of energy losses and wear which otherwise would be present.

VALVING MEANS OPERATION

Each stage of the present motor embodiment requires four valving ports, as compared to two in the case of a Wankel engine. As previously explained, this basic difference is the result of "externalizing" the combustion process. The benefits brought thereby are extensively discussed in the cited references and need not be repeated here for justification purpose. Particularly, two of these ports and valving means thereof need be discussed, though. They do not exist in the Wankel engine and their operations can be utilized to alter the character of the engine mode of operation. The simplest of these two valving means is the compressed air outlet valve. It is discussed first.

COMPRESSED AIR OUTLET VALVE

First, a pertinent general statement is appropriate here: the unnecessary throttling of a fluid flow always results in an energy loss. For that reason, the least throttling of any valve is illustrated in FIG. 1: i.e. a simple check valve, the spring exerting a minimal force on the valve and being present only to urge the valve to naturally close. Thus, practically, the degree of air compression is not established by the volumetric displacement of the "piston", but by the air pressure existing in delivery duct 42, or the air pressure existing in the compressed air compartment of storage tank 95. As discussed later, no throttling of air, ambient and/or compressed, is used for the control of the engine power. Thus there is no reason to introduce any. If there were, for whatever cause, a valve control and actuating system similar to that used for valve 45 could perform such task, though. The peak pressure existing in the compression chamber is not the result of a built-in compression ratio, albeit related to it. It is established now that the effective compression ratio is not determined by volume ratio per se, the latter remaining undefined and varying as the rotor position for which valve 40 cracks open also varies. This is an important point to keep in mind.

COMBUSTED GAS ADMISSION VALVE

At this juncture, it should be pointed out that this valve could also consist of a simple check valve operating in reverse of the air outlet valve, i.e. open to let combusted gas in when the pressure in the combusted gas compartment of storage tank 95 exceeds the pressure in the motor expansion chamber. Unfortunately, such operating condition is not practical because of the presence of the storage tank and of the free-piston combustor. This serves to justify: (1) the need for control of the amounts of combusted gas admitted per rotor "cycle", and (2) the concommittant need for automatically timing such admission. Intuitively, the reader familiar with the art will conclude that, under steady-state engine operating conditions, the mass of combusted gas introduced must approximately equal that of the air admitted, except for the discrepancies due to leaks, fuel injected and/or air expended in the air cushions. This, of course, is true. However, the following key question remains: how can that fixed amount of combusted gas be best and timely introduced in the expansion chamber?

The answer is: ideally all at once as soon as the expansion chamber volume has reached the volume that the compression chamber would have reached if and when all of that corresponding compressed air had also been instantly delivered. However, it was just stated that the latter is unknown and variable. The problem is identical to that of gas turbines in which the flow-pressure characteristics of the compressor and of the turbine must constantly match. Again intuitively, the reader familiar with the art could conclude that any rotor position between positions A and C is acceptable, provided that symmetry between compression and expansion is observed. Again, a comparison with the Wankel engine might be enlightening. The combustion chamber volume of such engine includes a recess volume corresponding to phantom line L carved into each curved side of the rotary piston between its flat faces, in addition to the two smaller equal volumes defined by the two halves of the rotor side curved surface and the external structure curved surface (and seal 37). Recesses in the rotor body cannot be present in the rotary piston of the subject invention for obvious reasons. Another important point is now established. The equivalent of compression and/or expansion ratios is determined by the operation of the combusted gas admission valve. The corollary is that the compression takes care of itself and is self-regulating and adjust to the "demand" for compressed air by storage tank 95.

Now ignoring compression for the time being, another consideration emerges, that of optimizing the combusted gas expansion so that thermodynamic cycle efficiency is maximized. Obviously, combusted gas can never practically expand to atmospheric pressure while energy is still being extracted from it, i.e. some back pressure is required to "push" the gas out of the engine. However, if no other constraints are imposed, e.g. stroke of a piston, it is of interest to lower the level of such back pressure to as close as possible to ambient pressure. This can best be achieved concurrently by combining two features: (1) have an exhaust port (50) as large as possible, and (2) adjust the volume confined between contour 46" and the curved surface of the external structure so that its ratio to the volume confined between contour A' and same said surface corresponds to the inverse ratio of the volumes which provide the amount of expansion desired.

Because combustion gas admission cannot be instantaneous, in the diagrammatic illustration of FIG. 1, the rotor lobe portion of interest is shown by instantaneous positions 46 and 46" which indicate when valve 44 begins and stops admission of combusted gas. Theoretically, the volume defined by the right branch of contour 46" and the inner surface of the structure 31 represent the amount of combusted gas admitted in the expansion chamber. The corresponding expansion ratio is also graphically defined. Practically, because fluid flows have finite velocities, some adjustments in position of ramps 64 and 65 of path 66 followed by detecting stem 49, relatively to the rotor, have to be made. Such consideration now brings up the subject of control. Although the position of rotor lobe detector 49 cannot be changed at will for obvious practical reasons, the response of valve 44 to shuttle piston 67 displacements, which must follow those of detector 49, can be altered temporally so as to provide means for affecting the opening and closing of valve 44 externally and at will.

A pneumatic system is shown in FIG. 4 as an example of the means which can be used for controlling and actuating valve 44. A combination of electrical/electronic means can also be used to that effect. For illustrative and descriptive purpose, both system approaches operate and perform similarly. The pneumatic system approach is preferred here because: (1) it is insensitive to high temperatures, (2) it can operate fast enough, (3) it is usually simple and reliable, (4) it is easily adjustable, and (5) a source of high pressure air is readily available. Although electric/electronic means are faster and offer greater flexibility, such advantages may not be fully exploitable here.

In any event, a time lag necessarily exists between the time detector 49 is pushed out as a rotor lobe passes by and the time actuating piston 72 responds and causes valve 44 to open. Similarly, a time lag also exists when detector 49 is allowed to return to its rest position and valve 44 is supposed to close. The extent of these time lags is function of the relative sizes of all interconnecting air ducting means in comparison with the volumes of the two spaces located above and below piston 72. The level of the air pressure available is several times higher than the pressure differential across valve 44. The diameter of piston 72 can be much smaller than that shown in FIG. 4. The volume displaced by the valve actuating means during the valve movement thus may be kept small. The time lag or delay mentioned above may thus be estimated, also kept small and accounted for.

For a nominal reference angular velocity of the rotary piston, the position of arrow $\phi$ or of the corresponding location of detector stem 49 can be adjusted or "advanced" so as to cancel the time delays in the responses of valve 44. The length $\lambda$ of the path followed by detector 49 end on the rotor lobe face establishes a fixed duration, in terms of rotor lobe travel, of valve 44 opening. Although $\lambda$ is built-in and cannot be adjusted, the relative positions between the end of detector 49 stem and path 66, and ramps 64 and 65 can be changed at will, as later is described and discussed. In addition, the closing of valve 44 can be caused to take place before detector 49 stem end has reached ramp 65. The adjustability of the opening of valve 44 seems unwarranted. It will be assumed that valve 44 practically opens immediately after an apex line has passed by port 41 "trailing" edge. Valve 44 is however enabled to close at an adjustable time, as will become clear later on, for engine power control purpose.

COMBUSTION GAS INLET AUTOMATIC VALVING

It is obvious that, although the use of positive mechanical valving provides timing adjustment possibilities, the long term satisfactory operation of valve 44 and of its actuating mechanisms in a high temperature environment and with no lubrication is questionable. A trade-off is possible, whereby the operation flexibility aspect of a valve system may be given up in favor of a frictionless valving system, such as that described in the diagrammatic drawings of FIGS. 16, 17 and 18. The construction approach is similar to that utilized in the automatic valving system of the free-piston combustor described in the cited references. The reader will readily understand that similar valving means can also be used for monitoring the closing and opening of of port 41 and establishing a set compression ratio value of the air compressing function, as described in the previous section.

Depending upon the mode of operation of the engine—similar to Diesel or to OTTO cycles—either compressed air or elevated pressure air can be used to prevent combusted gas from jetting through the gaps kept open between quasi-sliding surfaces. The air expended represents another loss of thermodynamic efficiency that constitutes the second part of the trade-off penalty. As is clear from the description given in the preceding section of the schematic diagrams of FIGS. 17 and 18, both the start and the end of the combusted gas admission period correspond to fixed positions of the rotary piston. However, because no time delays of any consequence are introduced hereby, the valving operation remains temporally identical regardless of motor regime or rpm's.

As indicated in FIG. 2, typically, the rotary pistons are arranged and the crankshaft is constructed so that the operation of two contiguous stages is phased-off 360°/n,n being the number of stages of the motor. The rotating timing and registering flange 220 incorporates n valving ducts 222 circumferentially located around flange 222 at angular intervals $2\pi/n$ and nominally positioned as described in the previous section. If compressed air outlet valving were also used, the corresponding ports would be positioned so as to duplicate the timing sequences and phase differences between compressed air exhausting and combusted gas admission which are apparent in FIG. 1. The thrust bearing function of flange 140 is not affected and air cushion pads 141 and 142 extend circularly around the flange, serving both as flange centering means and as barrier for combusted gas leaking through various gaps.

As described in the previous section, the rotor as a body revolves at an average of one third the angular speed of the crankshaft around a true CIR located at all times at the contact point between the pitch circles of gears 56 and 58. The instantaneous linear speeds of the rotor apex lines and side curved surfaces vary continuously because their distances to the rotor true CIR also vary steadily. For expediency reason, point 0' of FIG. 1 which describes circle Γ and is the rotor center was assumed to be the rotation center of the rotary piston provisionally for ease of descriptive convenience and chosen as a fixed position reference point for the rotor, but is not the true rotor CIR. The latter always moves, along the pitch circle of gear 56. For that reason, determining an exact spatial correspondence between "corresponding" positions of an apex line on the external structure curved surface and the rotor center on circle Γ requires a graphic accuracy which the schematic diagram of FIG. 1 cannot provide. It was however shown that, within a rough approximation, the timings of the start of combusted gas admission and of the end of compressed air exhaust can be separated by a safe amount during the angular motion of flange 220 outer cylindrical surface. Two aspects of the automatic valving need be pointed out now.

Figure 16:
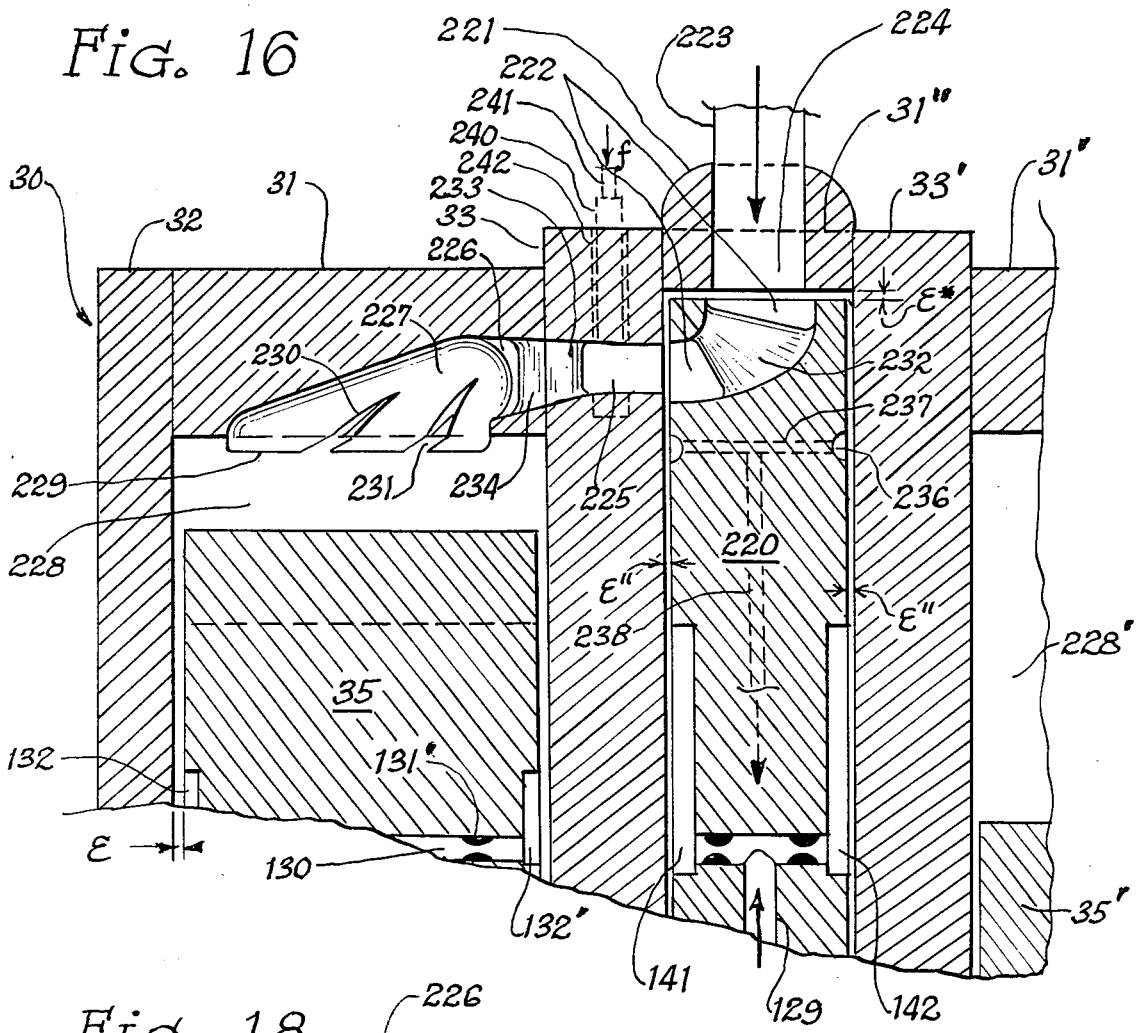
FIG. 16 is a sectional view of a typical automatic valving means for combusted gas admission in an expansion chamber.

The locations and sizes of ports 41 and 43 differ slightly from those shown in FIG. 1 for mechanical valves. Each port is rectangular in shape and thus requires a width smaller than the valve diameter. Its length, as depicted in FIG. 16, may extend a major portion of the external structure thickness. A sliding seal 170 (or 190) is also provided better support. The two ports are located farther apart and their contiguous boundaries can be separated an even greater distance, facilitating the installation and operation of seal 37. It should also be remembered that the positioning of the ports does not affect timing. The only two mandatory construction features are: (1) an apex line seal must have passed the outer edge of the boundary of the combusted gas admission port (trailing edge) before the corresponding ports on flange 220 and duct 224 begin to register, and (2) an apex line seal must not reach the outer edge of the boundary of the compressed air exhaust port (leading edge) before the corresponding ports on flange 220 and duct 224 end their registering. The volumes of cavities 227 and channels 225 represent the equivalent of "dead" volumes, especially for compressed air, which only slightly affect the motor efficiency. The volumes of these cavities should be minimized whilst being shaped for maximum fluid flow ducting efficiency.

AIR INLET VALVING MEANS

Although a valve per se is not required to let ambient air in the compression chamber and control such admission, a relevant basic construction difference between the present motor and Wankel engines already mentioned resides in the absence of the recesses indicated by line L. If an air inlet port such as 38 of FIG. 1 were present in a Wankel engine, the rotary piston recess would establish communication between gas exhaust port 50 and air inlet 38 when a rotor side curved surface occupies a position corresponding to rotor position E', which is unacceptable. To solve this problem, the closing and opening of air inlet port 39 located on one side of the compression chamber is monitored by the passage of a rotary piston lobe. In the motor construction of FIG. 1, as soon as a rotor side curved surface has made contact with seal 36, the rotor apex line may reach the "leading" edge 38' of an air inlet port, without establishing a chamber communication as earlier noted. In order to optimize the motor operation, it is likely that both design approaches should be used concurrently, the size of opening 39 being somewhat reduced so as not to interfere with the operation of the rotor side face air cushions.

CONTROL OF ENGINE POWER LEVEL

The control of the power level of EC engines utilizing free-piston combustors is extensively described and discussed in the cited references regarding prior art. This is not repeated here. Only the general approach, as applicable, hereto, is summarized. The control of the combusted gas admission valve alluded to previously is used concurrently and in connection with a properly modified version of the engine control system described in those references. Basically, the compressed air flow into the combustor is indirectly adjusted by the engine operator and measured. The amount of fuel required to obtain a pre-programmed combustion in that air is determined by electronic means including: (1) sensing means for determining compressed air conditions, (2) a Central Processing Unit (CPU) comprising a programmed computer and memory storage, and input and output ports, (3) means for delivering signals generated by the CPU, and (4) actuating means for adjusting compressed air and fuel flows into the combustion chambers, so as to maintain the fuel/air ratio determined by the computer per engine operator's input. Any and all engine regimes and/or operating conditions (power level) correspond to a set fuel/air ratio, be it during steady-state or transient engine running conditions.

The engine operator inputs a signal, e.g. gas pedal position, which he believes represents the power level that he expects the engine will deliver. That signal is delivered to the CPU computer which calculates the appropriate pre-programmed fuel/air ratio adjustment to get that power level. A proper opening setting is calculated for an air intake valve located between the storage tank and the combustor compressed air inlet. That signal is delivered to the actuating means of the valve and the opening thereof is set. The air pressures upstream and downstream of the air intake valve and the air temperature in the compressed air compartment of the storage tank are measured and used by the computer to determine the weight of air admitted in a combustion chamber. From the fuel/air ratio previously calculated, the computer calculates the amount of fuel weight to be injected in that combustion chamber. The fuel injection pressure and the duration of the injection are then determined and corresponding signals are delivered to the fuel system. Depending on the motor regime (rpm), the cycling frequency of the free piston adjusts itself automatically to satisfy the demand, or more appropriately to match the degree of compliance to combusted gas flow which the motor expansion member provides, of the motor for combusted gas. The motor either responds to the operator's satisfaction or does not match his expectation, in which case he alters his input to obtain the correct engine power output. Because the motor constructions of the cited references do not provide for controllable valving of combusted gas admission into the motor, adjustment of combusted gas admission for power level control is not contemplated therein. In the case of the present invention, the situation could be somewhat different for the first embodiment described.

It was earlier mentioned that both the opening timing and duration of the combusted gas admission mechanical valve are imposed by the movement of rotary piston lobe 47. The passage of that lobe causes a fixed position sensor to respond and indirectly actuate the valve. Neither the mechanical provisions present in rotor 35 lobe 47 nor the location of the sensor guiding bore in flange 33 can easily be made adjustable. However, two minor modifications in the geometries of the contacting parts can provide an appreciable degree of adjustability, as discussed below.

COMBUSTED GAS ADMISSION VALVE ADJUSTMENT AND CONTROL THEREWITH

Unless direct mechanical linkage is used between sensor 49 and valve 44, which appears undesirable and should be avoided, a time delay in the response of the valve to the sensor input is unavoidable. It may be minimized but not easily controlled for a pneumatic embodiment such as that which is preferred here. That delay is of fixed time duration and corresponds to a fixed angular position increment of the nominal position which lobe 47 is suposed to occupy when valve 44 opens. The size of that increment, for a given time delay, varies proportionately with the rotor angular velocity and thus of the motor regime. The latter could easily vary by a factor of 10. It is unlikely that the built-in time delay could ever be reduced to a value so small that it could be ignored as immaterial. In which case, a penalty results in the motor gas expansion efficiency. The construction modifications, and embodiments thereof, that provide a mechanical solution to the problem are shown in phantom lines in the drawing of FIG. 3.

First, path 66 and ramps 64 and 65 are given the shapes and dimensions indicated by 66*, 64* and 65* respectively. The end of sensor 49 which contacts lobe 47 surface is off-centered with respect to stem 49* larger diameter. Stem 49* is allowed to rotate in its lodging bore in flange 33. Thus, rotating stem 49* causes contact 49 to describe circle 29. Depending on the position occupied by contact 49 on circle 29, the timing signals generated by sensor 49 obviously vary. Valve 44 opening and closing timings and opening duration may then be adjusted by monitoring the angular position of stem 49*. The adjustability just introduced can be used in a manner such that the angular position of stem 49* is made responsive to the motor rpm's and to an input signal generated by the computer for controlling the duration of combusted gas admission, as a function of power level for instance in cooperation with the control of the air intake valve operation.

The two inputs are combined by the computer to establish an angular position of stem 49* that will most optimally adjust the position of sensor contact 49. The extent of radial adjustment obtainable from the off-centering, the positions and orientations of ramps 64* and 65* are determined so as to yield optimum tradeoff results between valve 44 timing corrections for motor rpm's and assistance for valve 44 opening duration adjustment to power level demands. Although only one type of motion (rotation) is possible here without undue mechanical complications being added, the reader will understand that the dissymmetry built in the sensing mechanism provides enough flexibility to adequately cover a useful range of most operating modes of an automobile engine.

Referring to FIG. 4, the angular position adjustment of an enlarged diameter sensor stem can easily be made by using a pinion for stop flange 27, this pinion 27 engages a rack 28 shown in phantom lines and actuated by means well known in the art and thus not shown controlled by signals delivered by the CPU. Shuttle piston 67 is not free to rotate and gear rack 28 is enabled to travel through it the full distance required to impose a full turn onto stem 49*. The pinion and rack gear teeth are straight so as to allow an unhampered axial motion of stem 49*. Readers familiar with the art will recognize that such an arrangement is usable with a valve system similar to that which can also be used for the control of compressed air delivery, instead of a check valve. In such case, the compression ratio of the motor can be adjusted by controlling the timing of the opening of the valve.

A pneumatic detecting system may also be used instead of the mechanical arrangement so far discussed. A thorough description of such system is given in my cited U.S. Pat. No. 4,665,703. It is based on the use of a proximity detector in which air flow becomes disturbed by an object passing close to a nozzle through which the air is being discharged, which causes the air pressure upstream of the nozzle to increase. Such a system is almost faithfully represented by the schematic of FIG. 6. Variable size restricting orifice 111 is the nozzle and piston 112 could be the actuating means of valve 44. The diameter of the nozzle needs only be larger than a few times the maximum clearance which may exist between flange 33 inner surface and rotor 35 side face. It is easy to understand that when lobe 47 passes in front of such nozzle, the apparent or effective size of the nozzle is greatly reduced and pressure $P_i$ rises appreciably. The end face of such a nozzle is flush with flange 33 iner surface and contact needs never be made with the rotor lobes. The nozzle diameter should be large enough to provide a fast response of piston 112, but no larger than that so as to minimize the amount of high pressure air that flows almost constantly through it. Such systems are of common use in fluidics control mechanisms and need no further elaboration here. The nozzle may again be mounted off-center on a rotatable stem such as 49* so that the radial position of the nozzle becomes adjustable in the manner previously described and the adjustable lobe arc length (i.e. path 66*) provides an adjustable valve opening duration, in terms of lobe angular travel, as was earlier pointed out. Except for the minimal friction caused by valve 44 guiding stem and its actuating piston, which could, however, be replaced by a metallic diaphragm so as to minimize friction further, valving by means of mechanical valves can then be rendered practically frictionless.

The use of mechanical off/on valves is required in the motor construction presented herein whereas it is not for the vane motors used in the EC engine embodiments presented in the cited references, because the vanes perform a valving function which the rotary piston cannot duplicate. The mechanical valving means thus imposed herein may be used during transient engine operating conditions so as to cut the motor off the storage tank, e.g. to use the motor for braking as is done with piston engines, with cars. Even in the automatic valving construction shown in FIG. 16, a gate-type valve 240 (shown in phantom lines) actuated by control rod 241 sliding in a lodging 242 when rod 241 is pushed in the direction of arrow f may be used to close channel 225 and stop fluid flow. In the case of air-pressure-actuated valves, a small shut-off valve installed on duct 73 can be used to stop the flow of high pressure air when necessary. If a check valve 40 is used for monitoring port 41, the possibility is also provided to prevent check valve 40 from opening by means of a mechanical stop V mounted as indicated in FIG. 1, and actuated by the control system when it is deemed necessary to isolate the motor from the compressed air space inside the storage-tank/heat-exchanger.

Two versions of motor braking mode are possible, depending on whether or not controlled valving is used for compressed air exhaust, be it accomplished by means of either one of the three approaches mentioned above: (1) port 41 may still open freely and port 43 is maintained closed, and (2) both ports 41 and 43 are maintained closed. In either possibility, fuel injection in the combustion chambers is of course stopped and the free piston automatically almost stops also. Practically, no fresh combusted gas is delivered by the combustor to the storage tank. In the first possibility, the rotary piston still delivers air into the storage tank for a very short while. This stops when the pressure therein becomes as high as the peak compression pressure which the much slowed down motor is able to muster. No combusted gas is introduced in the expansion chamber and the rotary piston operates like the piston of a suction pump. The pressure inside seal 37 is lowered by action of the control system so that trapped compressed air is allowed to leak into the expansion chamber. Motor braking action results from expending energy in compressing the air and then letting it expand wastefully through a throttled expansion. In the second approach, both valves 40 and 44 are kept closed. The difference in operation stems from the fact that compressed air is not allowed to flow out of the motor during the short delay provided by the first approach. The motor braking action is immediate and starts before the motor has had time to slow down. In this instance, the partial "deflation" of seal 37 must take place immediately.

For both approaches, the pressure control mechanism which monitors the operation of seal 37 is overridden by a signal input from the engine control system. When fuel injection and ignition are temporarily stopped, although the engine is not turned off, the control system signal causes the pressure inside seal 37 to become and to remain equal to the compressed air pressure existing in the storage tank. Thus the flexible membrane wall 156 of seal 37 is enabled to operate like a pressurizing-throttling valve. Such an operation is particularly well suited for rotary pistons equipped with apex line seals shown in FIGS. 12 and 14 in which the seal "apex line" radial displacement is limited. In the case of seal body 170 which is free to move out radially without restraint, such as approach will not be satisfactory. In such an instance, seal 37 and its operation are left undisturbed when motor braking is applied. Seal body 170 itself acts as a pressurizing-throttling valve. In FIG. 13, the air pressure in space 172 is automatically monitored by means of a combination of restricting orifices so as to remain a fraction higher than the maximum compressed air pressure existing in the storage tank. During motor braking, when the compressed air peak pressure reaches a fixed level, seal body 170 is pushed back into space 172 and acts as a pressurizing-throttling valve.

AIR COMPRESSION AND GAS EXPANSION MATCHING

As was previously mentioned in the description of the graphs of FIG. 15, the maximum thermodynamic cycle efficiency of an EC engine is obtained when the air compression and the combusted gas expansion are matched in a manner such that the exhausting combustion gases are pushed out of the expansion chamber by a back pressure no higher than necessary. This is reflected by the cycle illustrated in dotted lines as a-b-g-e-h-a (DAVID Cycle). In different ways, one may say that volume V″ of the expansion chamber is larger than volume $V_o$ of the compression chamber, which means that the compression ratio and the expansion ratio, as conventionally expressed, must be different. Geometrically and kinematically speaking, the shapes, displacement volumes and motions of the rotary piston and of the external structure inner curved surfaces—as applicable—must be identical for reasons of symmetry, as is clearly illustrated in FIG. 1, and the apparent compressing and expanding volumes must be equal. This of course is the case in a Wankel engine and, as is well known, in a piston engine also, for even more obvious reasons. The Wankel engine thus is obligated to operate according to an OTTO Cycle such as a-b-c-e-a, as is well known. In the above discussion, the influence of the "bleed-off" of compressed air for use in the high pressure air system of the present EC engine was provisionally ignored.

It has been estimated (cited references) that, as a first approximation, the "loss" of compressed air in the air cushions of the free-piston combustor and of the motor, and not expanded as combusted gas in the motor, corresponds roughly to the "gain" that volume difference $V''-V_o$ provides, in compression ratio equivalence. Such rough approximation could suffice, but it is of interest to establish in general all the possibilities of the motor of the present invention. It would be wasteful and inefficient in all instances not to expand fully all of the combusted gas generated by the combustor. However, the present EC engine construction permits two adjustments singularly or in combination: (1) that of the compression ratio (or of volume $V_{o,c}$), and (2) that of the expansion ratio (or of volume $V_{o,e}$). $V_{o,c}$ and $V_{o,e}$ correspond respectively to the volumes occupied by the compressed air and the combusted gas when the valve of the former opens and when the valve of the latter closes. The use of an additional combusted gas expansion stage may also be contemplated and embodied by means of a supplementary stage (stage 59 of FIG. 2). This possibility is discussed first, hereinunder.

The use of such additional expansion stage particularly suits motor constructions that do not utilize air cushioned journals, in which the consumption of high pressure air could be appreciably lower, as earlier explained. That stage expansion ratio is of the order of 1.5/1, a maximum of 2/1 would be the upper limit. A simple vane motor (expansion stage only) similar to those described in the cited references is more than adequate for such task. For construction simplification sake, rotor 61 is mounted on common shaft 51. Thus rotor 61 rotates at the same speed as the motor. One additional expansion stage serves both motor stages of FIG. 2. The combusted gas expansion down to atmospheric pressure is performed in annular chamber 26, shown in FIG. 2 as being possibly being undersized. The reader should remember that gas expanding is continuous to a vane motor, whereas intermittent in a rotary piston motor. In any event, the volume of annular chamber 26 is calculated and designed to accommodate the expansion of all combusted gas generated by the engine.

The entities $V_{o,c}$ and $V_{o,e}$ earlier defined must both be ratioed to V' in the case where no additional gas expansion stage is used because compression and expansion are matched by means of valving adjustments. For the sake of simplicity, V' is assumed to be the same for both functions. Thus $r_c = V'/V_{o,c}$ = compression ratio, and $r_e = V_{o,e}/V'$ = expansion ratio. In a Wankel engine, $r_c = r_e$, by construction. In an EC engine with a rotary piston motor, valving permits $r_c \neq r_e$. For the purpose of this discussion, only steady-state engine operating conditions are of practical interest here. The locations of ports 41 and 43 and the timings of the opening of the compressed air valve and of the closing of the combusted gas valve (mechanical valves and automatic valving alike) are established for nominal engine operating conditions (rpm and power level), the adjustments previously mentioned, if any, being of course brought about in a manner intended to minimize their disturbing influences on that nominal matching-off-design points.

As becomes manifest from an examination of FIG. 1, the rotary piston motor can theoretically provide compression and expansion ratios well in excess of values of interest by virtue of its fixed geometry, as compared to piston engines in which the volume ratio between combustion chamber and piston displacement may have any value. In the Wankel engine, the recessed cavity in the rotor body as shown by line L provides the degree of freedom required to set the compression ratio at a value appreciably lower than that which a geometry without recess would impose, regardless of the consideration of required space connection earlier mentioned. The above is evident when one looks at the outermost right curved side surface contour (reference contour) of a rotor in position B. It is obvious that exhaust of compressed air must begin when that reference contour is between positions A and B, and that admission of combusted gas must stop when that reference contour is between positions B and C, as earlier indicated in the discussion of the timings of the automatic valving system.

As a first approximation, assuming that X% of the compressed air do not later re-enter into the expansion chamber, compressed air is exhausted and combusted gas is admitted at the same pressure, and combusted gas has Y% (Y smaller than 1, because combusted gas is much hotter than compressed air) the density of compressed air, at a nominal set design point, a basic relationship can be established between $V_{o,c}$ and $V_{o,e}$, X and Y as follows: $(1-X).V_{o,c} = Y.V_{o,e}$ if the influence of the fuel amount is included in the value of Y and thus rendered immaterial. This further assumes that air and gas pressures are constant while the respective valves thereof remain open, and that the compressed air exhaust valve opens when $V_{o,c}$ is obtained from space S reduction and the combusted gas admission valve closes when $V_{o,e}$ is reached by an increase in space Σ volume (steady-state condition).

The analysis presented above is intended to demonstrate that the positioning of the valve ports, assuming that, provisionally, the valve timings correspond to the timely reaching of the port edges by the apex line seals as described in the preceding section, determines and fixes the values of $V_{o,c}$ and $V_{o,e}$. These values correspond to the nominal compression and expansion ratios which will minimize the amount of back pressure. The reader familiar with the art will understand that simplifying assumptions are implicit in the reasoning above, i.e.: (1) the polytropic air compression and gas expansion are assumed to follow the same thermodynamic relationship, which is not true because combusted gas has lower polytropic coefficient than air and the temperatures of the gas are much higher than those of the air, meaning that pressure ratios and volume ratios relate in a different manner for air and gas, and (2) the compression and the expansion chambers are not sealed off and air/gas leaks occur during the compression/expansion processes. However, the influences of these factors can be taken into account in more refined analyses and experimental data will help determine the amount and influence of air/gas leakage.

To provide the maximum of flexibility and effectivenes of the valving means in further adjusting compression and expansion ratios, if the operation of both compressed air and combusted gas valves is also overridingly monitored by the engine control system, the leading and trailing edges of ports 41 and 43 respectively must be positioned as closely as possible to each other. These two positions then determine the highest compatible values of $V_{o,c}$ and $V_{o,e}$ for which 100% filling of space $V_{o,e}$ causes a minimum back pressure when valve 40 opens as soon as it is allowed to. They are estimated to correspond to points such as $a_1$ for the position of apex line $0_1$ and $d_1$ for the position of apex line $0_2$ on the external structure curved inner surface. The adjustability of $V_{o,c}$ and $V_{o,e}$ downward is provided by causing valve 40 to open sooner (e.g. position a of $0_1$) and valve 44 to close later (e.g. position d of $0_2$). Arcs a-$a_1$ and d-$d_1$ represent time adjustments of valve timings, i.e.: (1) opening of valve 40, and (2) closing of valve 44. The values of $V_{o,c}$ and $V_{o,e}$ which correspond to extreme positions a and d of $0_1$ and $0_2$ respectively cannot fulfill both the relationship earlier derived and the minimum back pressure condition simultaneously, unless at least one of the assumptions previously made is violated or another variable is introduced, as explained below.

With the assumptions made earlier, if $V_{o,c}$ varies, the amount of compressed air delivered does not vary, only its pressure does. If $V_{o,e}$ increases, the amount of combusted gas admitted at constant pressure increases concomitantly. Because $V_{o,e}/V'$ has been reduced, the back pressure level increases appreciably. That situation can be corrected by reducing the amount of combusted gas admitted in $V_{o,e}$, resulting in lower pressures and violating the constant pressure assumption, by shortening the duration of the opening of valve 44. Thus, without adjustment of the valve timing and relying only on the built-in automatic timings, there is only one set of points such as $a_1$ and $d_1$ for which both earlier made assumptions and back pressure condition are valid. The corresponding design values of the compression and expansion chamber reference volumes are $V_{o,c}$* and $V_{o,e}$*. For ease of illustration, it will be assumed that they correspond respectively to points $a_1$ and $d_1$ of FIG. 1. The range of compression and expansion ratio adjustments in the reverse direction can be further extended to points $a_2$ and $d_2$, keeping in mind that such adjustments result only from engine control system action. It is worth noting that d, $d_1$ and $d_2$ are closer than a, $a_1$ and $a_2$ respectively to the vertical axis of symmetry of FIG. 1, indicating that $V_{o,e}$* is obviously larger than $V_{o,c}$*, as the relationship earlier derived indicated should be the case. Thus, in conclusion, a motor nominal design condition can be determined for set compression and expansion ratios, and automatic valving timings satisfying all assumptions made and the condition of minimal back pressure or of minimum efficiency loss. Off-design engine operating conditions can be obtained by means of adjusting the timings of valve 40 and 44, during either transient or steady-state engine operating conditions, so as to keep the relationship above almost satisfied.

Steady-state operating conditions correspond to a quasi constant level of engine power output maintained for a long time. Engine efficiency, i.e. low fuel consumption, is of prime importance. Back pressure must then be kept continuously at as low a level as possible, at all engine power settings. In the present engine, throttling of air admission in the motor is not used. Excessive compressed air throttling between the storage tank and the combustor is energy-wasteful. Adjusting down the amount of combusted gas admitted in the expansion chamber to lower power level is a more efficient process, if done by adjusting the duration of valve 44 opening and not by means of throttling gas admission. Shortening the opening duration of valve 44 can best be achieved by causing valve 44 or gate valve 240 to close before it is done automatically by means of either air signal or off-registering of cooperating ports. The expansion ratio is increased as a result. Adjusting up the amount of combusted gas admitted, from the nominal design point condition which may correspond to a set percentage of the full power setting ($V_{o,e}$*), can be done by delaying the closing of valve 44 and/or advancing its opening. It should be noted that time delaying is more effective than opening advancing per time unit. It is however a less energy-efficient process.

Because the engine power control system uses fuel-/air ratio as a parameter to set the shaft power output level, the temperature of the combusted gas admitted in the motor decreases as the power level. The combusted gases are thus denser at lower power levels or "lighter" at power levels higher than that of the nominal design point. This indicates that, everything else remaining equal, $V_{o,e}$ should be adjusted down for lower power levels and up for higher power levels. In addition, the present EC engine is capable of operating according to a semi-OTTO Cycle, as shown in FIG. 15. In such case, the pressure of the combusted gas may far exceed the pressure of the compressed air. The value of Y in the relationship varies accordingly and $V_{o,e}$ must be adjusted to compensate for such variations. At this juncture, noting that $V_{o,e}$* design values of a rotary piston motor must differ according to the thermodynamic cycle type adopted for the engine operation suffices. A more elaborate treatment of the subject would be beyond the scope of the present disclosure.

Concurrently with the use of combusted gas admission adjustment for contributing to power level setting, compressed air delivery can be used as a complement, by means of compression-ratio adjusting. In this instance, the duration of the opening of valve 44 needs not be affected, only the valve opening timing, which affects the value of $V_{o,c}$. It might be that, for certain engine operational conditions, lowering the compression ratio to contribute to the adjusting down of power level is a more effective and efficient process than throttling compressed air and is worth mentioning. The possibility thereof exists in this motor.

The reader should keep in mind that the adjustments of combusted gas admission and possibly compression ratio by means of valve timing control for engine power level adjusting is only an adjunct to and of the engine control system, and controlled thereby. It may provide means for lowering fuel consumption by insuring that off-design point engine operations deviate less from ideal optimum operating conditions. The bulk of the power adjustment is still performed by means of the matched and concurrent settings of the fuel and air flows into the combustor by the control system, under steady-state operating conditions. During transient conditions, the situation is quite different, as shown below.

That difference is the result of the presence of the storage tank that injects an "inertia" factor or time delay between the compression and expansion sides of the motor. The influence thereof is irrelevant during steady-state but paramount during engine accelerations and/or decelerations. The roles that valves 40 and 44 may assume in the present invention motor were examplified by their capabilities of providing motor braking as was earlier discussed. Similar roles can be played by both valves when instantaneous large demands of power increase or power decrease are made by the operator. As an example, when the power level demand exceeds a rate of change and/or a value range and/or specified limits of combinations thereof, the engine control system can be caused to adjust the operations of the valves, and of seal 37 as applicable, in the manner previously discussed.

For example, during a quick large acceleration, valve 44 timings are altered so as to admit the maximum of combusted gas by maximizing valve 44 opening duration and volume $V_{o,e}$, while also maximizing the compression ratio (i.e. minimizing $V_{o,c}$), leaving seal 37 unaffected. Such an operation is inefficient but lasts only for a very short time, thus this is immaterial. More combusted gas is instantaneously drawn from the storage tank, the back pressure is suddenly increased and the torque exerted on shaft 51 augments appreciably. Potential "elastic" energy still contained in the exhausting gases is lost, but a burst of power is immediately provided. During a quick sizable deceleration, e.g. sudden release of the "gas" pedal, the process described earlier in the case of motor braking can be repeated, except that fuel supply and ignition need not be temporarily turned off but only adjusted to their idle settings. No combusted gas is admitted in the motor and most of the compressed air by-passes the storage tank, if valve 40 is still permitted to open for a small fraction of its usual duration. The reserve of combusted gas built up in the storage tank is thus immediately available for any possible ensuing quick acceleration. The above operating features are not present in a vane motor and additional valving would be required to duplicate the operation of those features.

If valve 40 is allowed to operate as a one-way valve during engine steady-state operation, volume $V_{o,c}$ and the corresponding compression ratio are determined automatically by the pressure existing in the compressed air compartment of the storage tank, as earlier mentioned. However, the compressed air mass output per cycle is fixed, the duration of its delivery only varying, for a given motor rpm value. The combusted gas side of the motor, as a first approximation, is insensitive to the air compression side conditions, except to the extent that variations in air compression alter the energy amount needed for the compression function. The ensuing variations in air compression energy results in variations of torque available on shaft 51, assuming that the combusted gas admission conditions remain unchanged. The motor shaft power output is the only engine operation parameter affected. Under steady-sate conditions, a stable equilibrium quickly establishes itself and the compressed air pressure level in the storage tank is set and kept. This fixes the compression ratio, thus a set $V_{o,c}$, and determines a point a* on the external structure inner surface by which the rotor apex line seal passes when valve 40 cracks open. The motor designer must only insure that the leading edge of port 41 is farther "down" than point $a_2$ that corresponds to the smallest value of $V_{o,c}$ and the highest compression ratio intended to be reached by that motor. Transient engine operation conditions are not sufficiently different from those previously discussed for an adjustable valve 40 to merit further discussion. The previous discussion pertaining to the combusted gas valve control and operation remains valid and applicable.

Specially for motors coupled with an engine designed to operate according to cycle a-b-g-h-a of FIG. 15, if peak pressure P' is appreciably higher than $P_d$, the average combusted gas pressure existing in the storage tank under engine steady-state operating conditions could remain consistently higher than the compressed air average pressure. It might then prove impractical to attempt matching compression and expansion ratios by means of motor construction and valve adjustment only. In such instance, an additional expansion stage is mandatory, if the energy corresponding to portion a-e-h-a of cycle a-b-g-h-a is to be extracted by further expansion of the combusted gas exhausting out of the rotary piston stages. A vane motor was earlier mentioned for that stage. Such a motor is typically characterized by a fixed expansion ratio. The expansion-ratio adjusting features of valve 44 control/actuation system can be retained and used in such case.

However, another possibility exists. It was earlier noted that the presence of the mandatory valving required by rotary piston motors operating as is described herein offers the flexibility of varying the expansion ratio by means of valve control action, seemingly by a sizable factor. The additional stage can use a rotary position instead of vanes and utilize such operation flexibility to the effect that the major part, if not all, of the total expansion ratio adjustment is performed by controlling the gas admission valves of the additional rotary piston stage. For ease of discussion and understanding, in the following, the combusted gas exiting out of ports 50 is referred to as gas, the exhaust combusted gas leaving the additional stage is called gases, the additional stage is referred to as just stage, the combusted gas admission pressure in the motor is not assumed to remain constantly equal to the compressed air pressure and the stage services all dual-function stages of the motor.

With those assumptions and definitions, the stage consists of one rotary piston mounted on crankshaft 51 and rotating inside its own external structure. Both chambers formed between the rotary piston curved sides and the external structure curved inner surface are used for gas expansion. Using FIG. 1 schematic drawing for illustrative purpose, keeping the rotation direction previously adopted, a gas admission valve is located where valve 44 is located and symmetrically, where port 38 is located. Two ports for the exhaust of gases are positioned where port 50 already is and where port 41 is located. If one follows the rotary motion of the rotor, it becomes apparent that: (1) two expansion cycles occur during each rotor revolution (obvious), (2) the two expansion cycles are out of phase, and (3) expansion ratios higher than 2/1 are possible. The mounting, guiding, restraining and centering of that rotor can be the same as those adopted for the other rotors. Apex line sealing and seals 37 and especially 36 could probably be dispensed with. The stage rotor motion is automatically synchronous with that of the motor rotors. The gas ducts and the angular relative positions between the stage rotor and the motor rotors can both be arranged so as to make one chamber of the stage service one set stage of the motor. The angular positionings and sizes of the various ports can be also arranged accordingly.

Basically, the rotating motion of the stage rotor and the positions of the port edges cooperate in insuring the coordinated registering—temporally speaking and not spatially—of the "activity" of port 50 with that of the admission port of the associated stage chamber. Thus, when gas leaves the motor expansion chamber through port 50, it is automatically enabled to enter its associated assigned expansion chamber of the stage. Combusted gas admission valves 44 are still used. They open and close automatically, but the duration of the opening is fixed in terms of the angular displacement of rotor 35. The duration of the opening of the gas communication channel between associated expansion chambers of the motor and stage is much longer than the nominal opening duration of valve 44. Therefore, in order to minimize the influence of fixed real-time timing errors on the engine operation, it seems more appropriate to utilize a timing valve between motor and stage and inserted in that communication channel for adjustment of the matching of the total expansion with the compression.

An indirect benefit of using an extra stage results from the fact that volume $V_{o,e}$* of the motor may be almost twice as large, and that the corresponding angular rotor displacement can also be larger. This compounds with the easing of the timing demands made on valve 44 and greatly simplifies its operation. Also, the pressures and temperatures of the gas are appreciably lower than those of the corresponding combusted gas. The end result is that: (1) the automatic valving means shown in FIG. 16 becomes ideally suited to this type of simplified operation mode, and (2) the timing valve adjustments and operation impose less exacting requirements on the control system and the valve moving parts.

Because motor and stage operations are automatically synchronized and always perfectly coordinated, only one common time origin is needed for the start and scheduling of a timing valve cycle. The use of the pneumatic detection system discussed earlier is preferred. It can be mounted between rotating flange 220 and a fixed flange such as 33. Associated cooperating timing grooves located on a corresponding face of flange 220 can be angularly positioned so as to provide the required automatic valve timing base and the actuating air pressure for the timing valve opening, as a reader familiar with the art may easily envisage. One pneumatic system on each face of flange 220 or two pneumatic systems on either face thereof, properly positioned angularly, may thus service the two timing valves.

The lengths and angular positions of the timing grooves are dimensioned and set so as to establish temporal matchings of the openings and closings of cooperating gas outlet ports of the motor and of the actuating air signals sent to the timing valves. OFF/ON control valves such as 20 and 21 of FIG. 4 used for illustration purpose and monitored by the engine control system and mounted on the timing valve actuating air connecting ducts determine and adjust the duration of these signals. The signal durations are calculated by the CPU computer so as to duplicate the types of timing adjustments previously discussed, be it during steady-state or transient operating conditions of the engine. It will be evident to a reader familiar with the art that: (1) a reduction of the opening duration of the timing valves results in a back pressure increase effect in the expansion chambers of the motor and a concomitant reduction of shaft power, and an effective augmentation of $V_{o,e}$* and a concomitant reduction of $r_e$* of the motor, (2) an increase in the opening duration of the timing valves results in the opposite effects, and (3) a nominal opening duration of the timing valves $\tau_e$* corresponds to a new nominal design value $V_{o,e}$* larger than that discussed previously.

The new value of $V_{o,e}$* is fixed and cannot (or needs not) be adjusted. The value of $\tau_e$* represents a set percentage Z of the total maximum time $\tau$ during which the timing valves could remain open, were it not for the temporal adjustments provided by the control valves. Z could be given by design a value between 70 and 80 percent for example, corresponding to the engine optimum operating regime. Thus, the timing valves may be adjusted up or down according to the engine power output level demanded by the operator, in the form of specified concurrent settings of fuel/air ratio and corresponding air intake valve area.

Time $\tau$ is not expressed in real time, but corresponds to a percentage of shaft 51 angular rotation. The CPU computer operates on real time. Real time and angular positions of shaft 51 are of course related by the shaft rpm's, which is detected by means of the pneumatic sensing system and inputed in the CPU. The timing calculations by the computer are carried out in terms of time and the timing-valve control valves receives times signals for opening and closing in real time, as generated by the control system computer. A new time base origin is generated for each valve cycle when the leading edge of a groove uncovers the sensor nozzle end face. No timing error can thus be caused by either mechanical part slippage, made impossible by construction as previously pointed out, or time-calculation error stack-up.

It is worth mentioning here that adjusting the values of $\tau$ as a means for altering the amount of energy extracted from the combusted gas expansion in the motor is more efficient than varying the degree of opening of the timing valves. The latter results in throttling the gas flow between motor and stage. If adjustments of the timing valves are used only during quick transient and motor braking conditions, as earlier mentioned, such efficiency losses can be neglected and ignored. In such case, the control valves are used to adjust the timing valve travels (i.e. degrees of opening) and not opening durations. In either instance, theoretically, the end results are the same in terms of engine behavior. If and when needed, as applicable, the coordination earlier mentioned between compressed air outlet valve and combusted gas admission operations is now conducted between said compressed air outlet valve control means and the timing valve control means. Further discussion seems unwarranted.

MOTOR COMPRESSION/EXPANSION MATCHING AND ENGINE CONTROL

As previously discussed, the possibility presented by a rotary piston motor of efficiently regulating either combusted air admission in the motor OR combusted gas admission in and compressed air exhaust out of the motor simultaneously can render the control of the engine more effective and alleviate certain drawbacks present in the case of vane motor utilization. This applies particularly to the use and operation of the air intake valve of the control system (cf. cited references). The air intake valve main function is to provide an efficient and effective way to create an adjustable minimum-pressure drop metering Venturi orifice. The average air flow rate through this Venturi may vary in a ratio of 15 to 1 between engine full power and idle settings, for corresponding power ratio of 60/1 and motor rpm ratio of 30 to 1. The ratio of the valve throat areas between idle and full power however is much less, e.g. 4 to 1 for an EC engine using a vane motor with a corresponding air pressure differential ratio of 5 or 6 to 1. A complementary ratio of about 12 to 1 results from the combustion of fuel/air ratio adjustments and piston cycling frequency variations, the only parameter left completely free to adjust itself, according to the level of the combusted gas pressure built up in the storage tank. As an example and for ease of discussion, the fuel/air ratio p can be made adjustable between limits of 3 (full power) and 1 (idle), leaving a ratio of 4 to 1 for piston frequency adjustments. The value of p and of the air intake valve throat area are adjusted simultaneously by the operator according to a fixed linear relationship, between the values of 0 (idle) and 100% (full power) of the displacement of a gas pedal for instance. During transient operating conditions, the fuel/air ratio is allowed to deviate from the constraints of this linear relationship and reach constant set values corresponding to those of full power setting during fast accelerations and idle during large decelaration periods, to limit the production of pollutants and the risks of misfires.

The engine power control approach described above remains basically the same for an EC engine equipped with a rotary piston motor. However, adjustment of combusted gas admission into the motor is available. For reasons which readers familiar with the art will understand, the bulk of the engine power control cannot be assumed by this adjustment. But a share of the air intake valve throat area adjustment can. A possible examplary sharing could be ratios of 2 to 1 for the air intake valve and for the combusted gas admission valve alike, as substitution for the 4/1 ratio allocated for the air intake valve alone when used with a vane motor. It may be assumed provisionally that the adjustments of both valves vary simultaneously in a linear way between idle and full power settings. The design values $V_{o,c}$* and $V_{o,e}$* previously defined correspond for instance to a ratio of roughly 1.8 to 1 for the nominal design point setting of the combusted gas admission valve—or gas admission valve as the case may be, if an additional expansion stage is used.

As a reminder and for easy reference, the various ratios (full power/idle) discussed above are summarized in the table below.

TABLE A

| Ratio Type | Symbol | Ratio Definitions and Values Range Value | Remarks |
|---|---|---|---|
| Power | $\rho$ | 60/1 | Could be appreciably higher |
| Air Flow Rate | R | 15/1 | By weight and very approximate |
| Motor rpm | | 30/1 | For Information only |
| Fuel/Air | p | 3/1 | Weight Ratio |
| Piston Freq'y | f | 4/1 | Variable, not set by design |
| Air Valve Area | | 4/1 | With Vane Motor only (Ref.) |
| Air Valve Area | | 2/1 | With Rot. Pist. Motor & ap- |
| Comb. Gas Adm. | | 2/1 | plicable only if both used. |
| Air Pres. Dif. | $\Delta P$ | 3-5/1 | Variable |

Theoretically, the high values above correspond to full maximum engine shaft power and 1 corresponds to idling operation. $\Delta P$ represents a relative value of a pressure differential as compared to the compressed air pressure existing in the storage tank (cf. cited references). The product of all of the high values above does not equal 60 and is not supposed to. The most likely deviations from the values given above as examples are those pertaining to $\Delta P$, f, $\tau$ and rpm of course.

Nevertheless, the numerical data above indicates that the use of a combusted gas admission valve facilitates the task of the air intake valve. A smaller range of valve throat are variations combined with a concurrent smaller range of $\Delta P$ variations means that the degree of compressed air throttling by that valve can be appreciably lessened compared to that which takes place in a vane-motor EC engine with similar specifications. In the latter case, during transitory engine running, the air intake valve is also used to perform tasks which the combusted gas admission and the compressed air outlet valves are capable of performing in a rotary piston motor engine.

STORAGE TANK AND HEAT EXCHANGING

More so with a rotary piston motor than is the case with a vane motor, an EC engine in which fuel combustion is slowed down for reasons extensively discussed in the cited references needs storing compartments for both compressed air and combusted gas. Combustion neither can be continuous nor should occur pulsatingly at the frequency of the rotary piston cycles. It is not only logical but practical to "envelop" the hot combusted gas by cooler compressed air and arrange the two storage volumes concentrically so as to form a natural heat exchanger. Aside from the thermodynamic cycle efficiency gain that heat exchange provides, other advantages result from an optimum combinations of the two compartments, i.e. combusted gas compartment contained inside the compressed air compartment. They are: (1) cooler external structure, (2) lower structure weight, (3) lesser risk of accidents, (4) more efficient heat exchange process, (5) lower combusted gas temperatures, (6) lower operating temperatures of motor components, (7) faster and more efficient combustion process, and (8) lower temperatures of the exhaust gases.

Advantages (1), (2), (3) and (4) will be obvious to readers familiar with the art. Advantages (5) to (8) merit some discussion. Ignoring all other considerations for the time being, for a given EC engine, most energy-efficient designs correspond to those which burn fuel stochiometrically and which generate the highest combusted gas temperatures (OTTO Cycles). Theoretically, free-piston combustors in which the piston rides on air cushions and is detected pneumatically, and the piston/-sleeve assembly is equipped with automatic valving means, are capable of such extreme type of operation. Therefore, it can be assumed that combusted gas at very high temperatures could be leaving the combustor. If such gas were delivered directly to the motor, the operating temperatures of moving parts would be well in excess of limits that are considered safe, even for so-called high temperature materials. The possibility of operating the motor without lubricating the sliding surfaces of the motor in contact with such hot gas is worth the efficiency loss that results from the use of cooler combusted gases.

In the extreme theoretical case of stochiometric fuel combustion in the combustor, the temperature rise created by fuel burning is several hundred degrees centigrade. Thus a temperature differential of the same order of magnitude exists between compressed air and combusted gas average temperatures in the storage tank. The compressed air temperature is raised a few hundred degrees and that of the combusted gas is lowered by the same amount. For this reason, the compressed air inlet of the high pressure air compressor 90 should be connected by duct 90' to the delivery duct connecting motor 30 to heat exchanger 95. The influence of high pressure air leaks into combusted gas is difficult to assess because the manner by which such leaks are channelled is more important than the magnitude of the leak itself. The beneficial effects of such leaks, though appreciable, are ignored because they do not affect the trend discussed here.

As readers familiar with the art of heat exchanging know, all other things being equal, the amount of heat exchanged between two fluids increases when the thickness of the wall separating the two fluids decreases and when the area of that wall increases. Two practical conclusions may be drawn therefrom: (1) the pressure difference between the two fluids should be kept as low as possible so as to reduce the wall thickness, and (2) the volume of the heat exchanger should be as large as possible so as to increase the exchange duration and minimize the fluid pressure losses inside the heat exchanger. These two conclusions directly relate to the type of motor used and to the engine cycle as is explained in the following.

The volume of the storage tank affects the transient responses of an EC engine with a vane motor, unless additional valving means otherwise useless is used. Such valving means is provided with a rotary piston engine by construction. As was earlier discussed, the controlled operation of the combusted gas admission valve during engine transient conditions eliminate the influence and importance of the storage tank volumetric capacity. As a matter of fact, a larger storage tank could prove more advantageous in that instance. As previously mentioned, an OTTO Cycle imposes both combusted gas higher temperatures and pressures concomitantly, and thus large pressure differences across the heat exchanging wall but fortunately directed outwardly. The higher the temperatures, the higher the pressure differentials and the thicker the heat exchanging wall. In terms of overall engine thermodynamic efficiency, reaching for stochiometric fuel combustion and combusted gas highest temperatures may not always be the optimum manner to obtain the highest engine overall efficiency. Only specific engine designs can be analyzed to provide satisfactory answers. It is intuitively felt, though, that an OTTO-Cycle engine design optimized accordingly will exhibit the characteristics represented by the left side of the DAVID Cycle illustrated in FIG. 15 in which point g (peak pressure P') is lower than corresponding point c (peak pressure P*) representing an ideal stochiometric fuel combustion and highest combusted gas temperatures.

As is the case for all powering machinery, cost is the determining factor that guides design. The nature and grade of fuels that may be burned in EC engines equipped with free-piston combustors depend very little on the type of motor used. Thus the guiding cost factors to rely on are the manufacturing costs and the trouble-free lifetime of the motor, for a given combustor type. Ideal motor component materials are those which retain strength at high temperatures and have quasi-nil thermal expansion. Such materials, for equal high temperature strength and fabricability, will impose the compromise between motor part operating peak temperature and thermal expansion characteristics which provides acceptable performance at the lowest overall cost. It is almost certain that such compromise will result in the intuitively arrived at conclusion above. From such peak operating temperatures of the motor parts, a storage tank design will be derived. Its practical limiting characteristics will in turn dictate the peak temperature of the combusted gas leaving the combustor.

This acceptable peak temperature, for a given fuel type and standard atmospheric conditions, automatically establishes the maximum fuel/air ratio at which the combustor must operate under engine steady-state operating conditions. During acceleration periods, the fuel/air ratio may reach a stochiometric value however. In Diesel-type engine operations, the fuel/air ratio never reaches values close to stochiometric. Such conditions again can occur only during engine acceleration periods. The design and construction of the storage tank are then greatly simplified, as are those of the motor components and critical parts.

MATERIALS

Candidate materials usable in the construction of the rotary motor of the present invention for which neither cooling nor lubrication is contemplated fall in two major categories: (1) reinforced densified carbon/-graphite materials, and (2) ceramics. For some motor parts such as the crankshaft, rollers (roller bearing journals) and the gears, high temperature steel alloys should be considered, however. High temperature steel alloys are widely used and well known. They need no further discussion.

Densified carbon and graphite materials reinforced with fibers of the same base material have been and are being constantly developed and improved. The technology is well known. Such materials are discussed in the cited references and their fabrication is described in the case of typical parts such as the flexible vanes of a vane motor. Suffice it to mention that carbon or graphite based materials are characterized by: (1) self-lubricating properties, (2) low thermal expansion, (3) increasing strength up to the temperatures of interest here, (4) high modulus of elasticity, and (5) the possibility of adjusting the characteristics of (3), (4) and (5) above by means of base material (fibers) arranging and manufacturing process tailoring. However, a nil coefficient of thermal expansion is not foreseeable.

Ceramics are new comers in the field of structural materials. They hold such promises that their study and development are actively pushed for applications to gas turbines and internal combustion engines. Zirconium oxide is an example of such material that is contemplated for parts of Diesel engines. Many other ceramics such as carbides, oxides and borides of various elements are also considered. However, they are all somewhat brittle and extreme manufacturing care is required. Element combinations can be arranged so as to obtain materials having a nil coefficient of thermal expansion. The combined use of carbon/graphite-based materials for some parts and of ceramics for others is also possible. The general design and construction of the various parts entering into the motor assembly and shown in the illustrations herein do not point out any specific impossibility. The most questionable item pertains to the gears, which was extensively discussed earlier.

It is thought that the rotary piston motor combined with a free-piston combustor and method of so doing of the present invention and many of its attendant advantages will be understood from the forgoing description and it will be apparent that various changes may be made in the form, construction and arrangement of the parts thereof without departing from the spirit and scope of the invention or sacrificing all of its material advantages, the form hereinbefore described being merely a preferred or examplary embodiment thereof.

Having thus described my invention, I now claim:

1. A rotary piston external combustion engine, comprising:

means for compressing air and expanding combusted gas;

a shaft connected to the compressing and expanding means for delivering power by means of an external drive shaft;

an air inlet port opening for admitting ambient air in the air compressing means;

an outlet valve for venting the compressed air out when the pressure thereof exceeds the air pressure downstream of the valve;

an exhaust port opening in an external structure for venting the combusted gas out of the gas expanding means;

means for receiving compressed air from the air compressing means, means for mixing a fuel with the compressed air, means for igniting the mixture to produce combusted gas, and means for delivering the combusted gas to the expanding means, the compressing and expanding means including a plurality of rotor bodies, a plurality of generally oval-shaped hollow external structures surrounding and enclosing the rotor bodies, flange means for rotatably supporting the rotor bodies by the hollow external structures about the shaft axis, each one set of rotor body and associated hollow structure being positioned between two adjacent flanges, each external hollow structure having a continuously curved surface and each rotor body having three identical side curved surfaces positioned to face cooperating portions of the curved surface of the hollow external structure, any two adjacent side curved surfaces forming an intersection line parallel to the rotor rotational axis of symmetry and all such parallel lines thus formed being equidistant from one another and continuously substantially coinciding with a generatrix of the corresponding continuous curved surface of its associated external structure, each rotor side curved surface defining a variable volume sealed space in cooperation with the flange means and the external structure curved surface, seals positioned at locations where the side curved surfaces and the external structure curved surface come into sliding contact, the shaft having a plurality of off-centered cylindrical journal bearing lands and each rotor having a corresponding centered cylindrical journal bore for rotation around a cooperating journal bearing land, each rotor having one centered internal gear and one of the two flanges associated with said rotor having a pinion gear for engaging said internal gear of larger pitch circle diameter, the curvatures and relative positions of the facing surfaces being such that four of the sealed spaces are formed and progressively vary in volume as the rotor rotates, one set of two of said four spaces decreasing in volume while the other set of two spaces increase in volume, as relative displacement of the facing surfaces takes place, wherein the generally oval-shaped curved surface of each hollow structure has two orthogonal planes of symmetry defining two generatrices of the external structure curved surface that are the farthest opposed and two generatrices of the external structure curved surface that are the most closely opposed where two seals are located, one for each generatrix, for sealing sliding contact with the rotor curved sides that form three apices at their junction and three lobes therebetween, each apex being provided with a seal in continuous sliding contact with the external structure curved surface, and wherein four port openings are provided, one on each of the to sides of each one of the two most closely opposed generatrices, one first port being used as air inlet, the diametrically opposed second port being used as combusted gas inlet, a third port located substantially symmetrically to the first port with respect to the longest axis of the oval shape being used as compressed air outlet, and a fourth port located substantially diametrically opposed to the third port being used as expanded combusted gas exhaust port, whereby air admission occurs after a rotor apex has passed the first port while the inlet-vented sealed space volume increases, air compression occurs after the inlet is closed off by the rotor next apex and said volume then decreases, combusted gas admission occurs after one rotor apex has passed the second port, combusted gas admission occurs thereafter until a combusted gas inlet valve in control of the second port closes and then enables the combusted gas to expand until the rotor apex opens the fourth port or exhaust port;

means for detecting the position of a rotor lobe and associsted apex after said apex has passed the second port;

means for utilizing said rotor lobe position to monitor the actuation of the combusted gas inlet valve; and means for actuating said combusted gas inlet valve;

whereby the gearing ratio between the pinion gear and the internal gear is two thirds, each rotor has three curved sides and three apices, and the oval-shaped internal surfaces of the hollow external structures is shaped like two intersecting and symmetrical quasi-circular arcs, each one arc covering over half of a full circle, said intersections defining the locations of the most closely opposed generatrices.

2. An external combustion engine according to claim 1 wherein a storage tank is located externally to the compressing and expanding means, said storage tank including:

a centrally located inner section for temporarily storing combusted gas;

an outer section surrounding the inner section for temporarily storing compressed air;

a structure separating both sections for preventing mixing of air and gas and for enabling heat to be exchanged between gas and air during the residence thereof in the tank; and an external structure and attendant duct connections for containing the compressed air and combusted gas, for supporting the separation structure and for receiving and delivering compressed air and combusted gas.

3. An external combustion engine according to claim 2 wherein the production of combusted gas from air and fuel mixing is accomplished in a combustion member located externally to the compressing and expanding means, said combustion member including:

a sleeve having two end closures and supporting attendant compressed air and combusted gas duct connections, valving means and ignition means;

a free piston guided in the sleeve for reciprocating therein, thus alternatively forming two combustion chambers between each one of its two ends and the corresponding sleeve end closure;

means for coordinating the introduction of compressed air, the introduction of the fuel, the ignition of said fuel and the exhaust of the combusted gas resulting from the fuel combustion;

means for preventing the piston from making contact with mechanical parts during its reciprocating motion; and means for preventing the piston end from making contact with the corresponding sleeve end closure at the end of a stroke.

4. An external combustion engine according to claim 3 wherein mechanical contacts between the rotor body and other parts guiding its translational and rotational motions are prevented by means of pressurized air cushions located between the rotor and its supporting shaft journal bearing, and the rotor and its guiding flanges, said air cushions and attendant system including:

a source of high pressure air;

a plurality of ducts and associated connections for channelling high pressure air to the air cushions;

a first fixed size restricting orifice located between the high pressure source and the air cushion; and a shallow cavity forming an air cushion pad between two surfaces to be kept separated, the gap formed by the separation distance between said two surfaces along the perimeter of said cavity defining a second variable size restricting orifice through which the air inside the cavity is enabled to escape;

whereby said separation distance determines the level of the air pressure existing in the pad, thus the force urging the two surfaces to separate;

whereby two opposing identical air pads located on opposite sides of a portion of the rotor body constrained between two fixed surfaces then cooperate for maintaining that portion of the rotor body centered between said two fixed surfaces; and whereby a plurality of such air cushion pads distributed and arranged around the journal bearing and about the rotor body lateral flat surfaces sliding along the flanges thus cooperate to maintain the rotor constantly and continuously centered on the shaft journal and between the two flanges.

5. An external combustion engine according to claim 4 wherein an additional shaft-mounted rotor body and external structure assembly is mounted on the compressing and expansion means for providing supplementary combusted gas expansion means, whereby the combusted gas exhausting through the exhaust ports of the compressing and expansion means is enabled to further expand down to atmospheric pressure so as to minimize the amount of energy lost in the combusted gas when being vented to the atmosphere.

6. An external combustion engine according to claim 4 wherein an additional shaft-mounted rotor body and external structure assembly is mounted on the compressing and expansion means for providing supplementary compressing means for raising the pressure of a fraction of the compressed air to the high pressure level required for the operation of the air cushions, thus being the source of high pressure air.

7. An external combustion engine according to claim 4 wherein a circular flange structure is mounted on the shaft between two rotor-body/external-structure assemblies and equipped with air cushion pads so as to form a thrust bearing for absorbing and resisting loads axially applied in the direction of the shaft axis of rotation.

8. An external combustion engine according to claim 4 wherein a narrow slot is provided along each one of the apex lines so as to create a thin sheet of high velocity air emerging therefrom, said sheet of air forming an isolating barrier between the two chambers located on either side of the rotor apex lobe, and further comprising:

means for channelling high pressure air from the source of said air to the slot; and means for preventing mechanical contact between the slot edges and the external structure curved surface.

9. An external combustion engine according to claim 4 wherein a radially slidable seal is located along the apex line in each lobe of the rotor body, said seal construction including:

a radially cut slot for housing said seal having parallel faces for guiding and restraining the seal body;

two air cushion pads, one located on each slot faces;

air flow control means for automatically keeping the seal body centered between the slot faces by means of said air pads;

two air cushion pads, one located at each end of the seal;

air flow control means for automatically keeping the seal body centered between the two flanges guiding the rotor by means of said end air cushion pads; and means for insuring that a constant force continuously urges the seal to move outwardly toward the external structure curved surface for sealing the passage between the two chambers located on either side of the rotor body lobe.

10. An external combustion engine according to claim 4 wherein a tiltable seal is located along each one of the apex lines of the rotor body and enable to oscillate about an axis parallel to said apex line, said tiltable seal construction including:

a shaft extending from one face of the rotor to the other;

a web structure connecting said shaft to the sealing portion of a seal body, said body comprising two wings symmetrically positioned with respect to the web plane of symmetry and oriented and shaped to form a contiuum of the contiguous rotor side curved surfaces;

a bore in the rotor body lobe extending from one face of the rotor to the other of diameter slightly larger than that of the seal shaft for containing and restraining said shaft;

a slot cut in the rotor lobe and extending from one face of the rotor to the other, for housing and accommodating the web;

a recess cut in the rotor body lobe, one on each side of the slot, for housing and accommodating the seal body wings;

an air cushion pad located on the bottom face of each recess for lifting the associated wing;

air flow control means for automatically keeping the seal body balanced in a neutral position whereby each wing is lifted an equal distance off its own air pad;

two air cushion pads, one at each end of said shaft, for cooperating with the corresponding restraining and guiding flange;

air flow control means for automatically keeping the seal body centered between said two restraining and guiding flanges; and means for controlling the maximum force exerted by the seal on the external structure curved surface;

whereby the amount of friction between the seal and the surfaces on which it slides is automatically maintained below a set level, the apex line formed by the seal wings is enabled to adjust its position with respect to that of the theoretical apex line defined by the rotor side curved surfaces so as to accommodate small displacements of the rotor body off its nominal path, and the seal body is automatically prevented from jamming and binding in its lodging.

11. An external combustion engine according to claim 4 wherein the two seals located on the external structure curved surface have a flexible conformable surface which is constructed to adjust for forming a continuum of said curved surface, each one of said two seals comprising;

securing means for fixedly positioning the seal structure in a shallow-shaped recessed cavity formed on the inner surface of the external structure;

means for applying air pressure inside the seal structure;

means for enabling the portion of the seal structure not secured to but supported by the external structure to bulge out slightly beyond its unpressurized contoured shape when air pressure is applied inside the seal structure; and means for minimizing the amount of air leakage at the ends of the seal structure where the seal ends butt against the walls of the flanges located on either side of the external structure.

12. An external combustion engine according to claim 4 wherein the high pressure air needed for operating the air pads located on opposite sides of the rotor body is bled off the air cushion pads distributed around the shaft journal bearing by means of an air channelling system including:

a plurality of small holes substantially located in the mid-plane of the rotor body for connecting the journal bearing pads with a collecting duct;

a plurality of ducts substantially located in the mid-plane of the rotor body for connecting the collecting duct to feed holes connected to the air cushion pads of the rotor; and a fixed size restricting orifice located in each feed hole near the air cushion pad being supplied with air;

whereby the sizes of small holes and of the collecting duct are such that the air pressures existing in the journal bearing air pads are averaged in the collecting duct whilst the influence of the by-passed air flow on the operation of the journal bearing is minimized.

13. An external combustion engine according to claim 4 wherein the high pressure air needed for operating the air pads located on opposite sides of the rotor body is ducted through the shaft journal bearing by means of a ducting system including:

a double-lip slip seal surrounding the journal land for sliding rotation on the surface of the rotor journal bore and defining an annular space substantially located in the mid-plane of said journal;

a plurality of ducts for supplying high pressure air to said annular space;

a plurality of radially-oriented ducts for connecting the annular space to the rotor air pad feed holes;

a fixed size restricting orifice located near each air pad at the end of each feed hole; and means for securing said slip seal on the shaft journal land.

14. An external combustion engine according to claim 4 wherein the opening and closing of the ambient air inlet port is automatically controlled by the position of a rotor body lobe.

15. An external combustion engine according to claim 11 wherein the longitudinal axis of the shallow-shaped recessed cavity formed in the external structures for securing and housing the seals located therein makes a small angle with the generatrices of the external structure curved surface, whereby an apex line of the rotor body engages the seal surfaces progressively from one end of the seal to the other.

16. An external combustion engine according to claim 1 wherein the outlet valve for venting the compressed air is a check valve for enabling compressed air delivery to the storage tank when the pressure inside the compression chamber exceeds the pressure in the storage tank.

17. An external combustion engine according to claim 1 wherein a plurality of rollers are mounted between each journal land located on the shaft, operating as a crankshaft, and an associated bore located in a cooperating rotor body so as to form two contiguously positioned roller bearings, and further including:

a double-lip seal located between the two bearings extending around the journal land for forming a circular space between the seal lips;

means for channelling high pressure air from inside the shaft into said space; and means for channelling high pressure air from inside the space into the rotor body.

18. An external combustion engine according to claim 1 wherein a circular flange is mounted on the shaft for rotation therewith and located between two contiguous rotor-body/external-structure/flange assemblies, further comprising:

a plurality of open-ended channels in said flange, each one end of the two ends of each channels being shaped to form a port, one port being located on the outer cylindrical surface of said flange and the other port being located on one of the two flat faces of the rotating flange, the planes of said two thus associated ports being substantially orthogonal and the associated channel making substantially a right angle turn therebetween;

a plurality of corresponding ports located on the inner cylindrical surface of an external circular structure located between two contiguous assemblies and forming an enclosed space containing said flange, each one of said ports being connected to a gaseous-fluid-channelling duct;

a plurality of open-ended channels located in said assembly flange, each channel being substantially straight and traversing said assembly flange between its two end ports, each port being located on one of the two flat surfaces of the assembly flange;

and a plurality of open-ended channels located in the assembly external structure, each channel making substantially a right angle turn between two end ports, one port being located on the flat annular surface of said external surface and constantly registered with a corresponding port in the assembly flange, the other port being located on the continuously curved inner surface of the external structure;

whereby the ports of each channel in the rotating flange register once during each shaft revolution simultaneously with the corresponding ports in the circular external structure and the corresponding ports in the assembly flange, thereby enabling the gaseous fluid to flow between the channelling duct and a space inside the assembly external structure; and whereby the ports are angularly distributed, shaped and radially positioned so as to register during a fraction of each shaft revolution, the beginning and the end of said revolution fraction corresponding to fixed angular positions of the rotating flange, shaft and rotor bodies.

19. An external combustion engine according to claim 18 wherein half of the open-ended channels in the rotating flange are oriented for cooperating with the corresponding ports and channels of one rotor assembly and the other half of said cpen-ended channels are oriented for cooperating with the corresponding ports and channels of the other rotor assembly.

20. An external combustion engine according to claim 19 wherein the registering of some open-ended channel ports of the rotating flange determines the angular timing of the start and end, thus also the duration, of the admission of the combustion gas in the motor combusted gas expansion chambers timely and automatically with respect to the angular positions of the rotor bodies.

21. An external combustion engine according to claim 19 wherein the registering of some open-ended channel ports of the rotating flange determines the angular timing of the start and end, thus also the duration, of the exhaust of the compressed air out of the motor air compression chambers timely and automatically with respect to the angular positions of the rotor bodies.

22. An external combustion engine according to claim 19 wherein a shut-off valve controlled by an engine control system enables said control system to adjust the timings of the start and end of the gaseous fluid flow through the quasi straight channels in the fixed assembly flange at any time during the period of time when the corresponding cooperating ports are registered, whereby the angular timings and duration of the gaseous fluid passage through the ports may be further regulated by the engine control system as demanded by engine operation requirements.

23. An external combustion engine according to claim 11 wherein the means for actuating the combusted gas inlet valve and the means for applying air pressure inside the structure of the seal located between the air outlet valve and the gas inlet valve further include:

control means for preventing the opening of the outlet valve during engine deceleration periods; and control means for enabling compressed air to flow by the seal so as to escape from the air compression chamber into the gas expansion chamber, thus bypassing the combustor when needed;

whereby energy is dissipated in the process and a braking torque is then generated by the motor shaft.

24. An external combustion engine according to claim 23 wherein the means for detecting rotor lobe positions, the means for actuating the combusted gas inlet valve and the means for preventing the opening of said valve further comprise:

a sensing stem rotatable and slidable about an axis perpendicular to the surface of the adjacent flange in which it is guided and having a sliding contact tip projecting beyond the inner surface of said flange against which a rotor flat face slides, said tip end being off-centered with respect to the stem axis, a pushing end projecting beyond the outer surface of the flange and a stop for limiting the stem travel;

a slidable shuttle piston positioned by the stem pushing end for controlling the application of air pressure in an inlet valve pneumatic actuating mechanism;

means for adjusting the stem angular position;

control valves mounted on air pressure ducts connecting the shuttle piston to the pneumatic valve actuating mechanism for shutting off the duct connection;

means located on the rotor body lobes for progressively engaging and establishing contact with the stem tip, as the lobe surface passes by the stem location during a fraction of the rotor lobe travel, said fraction being rendered adjustable by means of the shape given to said progressive engagement means; and control means in an engine control system for setting the adjustment of the stem angular position and the timings of the control valve air pressure shut off as required by the engine control system in response to an engine operator's input signal;

whereby the angular position of the stem and the engagement means shape cooperate for adjusting set timings of the opening and closing of the combusted gas inlet valve, and a set duration of the combusted gas admission; and whereby the operation of the control valves enables the engine control system to further adjust said set timings and duration of the combusted gas admission into the motor.

25. An external combustion engine according to claim 24 wherein the adjustments of the combusted gas admission timings and duration enable the engine control system to directly affect:

the combusted gas expansion ratio;

the motor torque; and the engine power level for a given shaft rotational speed.

26. An external combustion engine according to claim 5 wherein the motor shaft-mounted additional assembly for providing supplementary combusted gas expanding means includes vanes.

27. An external combustion engine according to claim 5 wherein the motor shaft-mounted additional assembly for providing supplementary combusted gas expanding means includes a rotary piston.

28. An external combustion engine according to claim 4 wherein the source of high pressure air includes a compressor driven by the motor shaft.

* * * * *